US011362437B2

(12) United States Patent
Piegsa et al.

(10) Patent No.: US 11,362,437 B2
(45) Date of Patent: Jun. 14, 2022

(54) ANTENNA FOR MOBILE COMMUNICATION

(71) Applicant: Telefonaktiebolaget LM Ericsson (publ), Stockholm (SE)

(72) Inventors: Guenther Piegsa, Frasdorf (DE); Andreas Vollmer, Rosenheim (DE); Maximilian Goettl, Frasdorf (DE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 330 days.

(21) Appl. No.: 15/723,562

(22) Filed: Oct. 3, 2017

(65) Prior Publication Data

US 2018/0097293 A1 Apr. 5, 2018

(30) Foreign Application Priority Data

Oct. 5, 2016 (DE) ..... 10 2016 011 890.3

(51) Int. Cl.

| | |
|---|---|
| ***H01Q 1/24*** | (2006.01) |
| ***H01Q 15/14*** | (2006.01) |
| ***H01Q 19/10*** | (2006.01) |
| ***H01Q 21/06*** | (2006.01) |
| ***H01Q 3/46*** | (2006.01) |

(Continued)

(52) U.S. Cl.

CPC ..... *H01Q 21/062* (2013.01); *H01Q 1/246* (2013.01); *H01Q 3/46* (2013.01); *H01Q 5/392* (2015.01); *H01Q 5/42* (2015.01); *H01Q 15/14* (2013.01); *H01Q 19/108* (2013.01);

(Continued)

(58) Field of Classification Search

CPC ..... H01Q 21/062; H01Q 25/001; H01Q 5/42; H01Q 21/26; H01Q 19/108; H01Q 15/14; H01Q 3/46; H01Q 1/246; H01Q 5/392; H01Q 5/49; H01Q 21/30; H01Q 21/0006;

(Continued)

(56) References Cited

U.S. PATENT DOCUMENTS

| | | | |
|---|---|---|---|
| 6,930,650 | B2 | 8/2005 | Gottl |
| 7,079,083 | B2 | 7/2006 | Gottl et al. |

(Continued)

FOREIGN PATENT DOCUMENTS

| | | | |
|---|---|---|---|
| CN | 1886864 | A | 12/2006 |
| CN | 201741796 | U | 2/2011 |

(Continued)

OTHER PUBLICATIONS

Machine translation of Jelloul CN Publication 1886864A (Year: 2006).*

(Continued)

*Primary Examiner* — Dimary S Lopez Cruz
*Assistant Examiner* — Michael M Bouizza
(74) *Attorney, Agent, or Firm* — Withrow & Terranova, PLLC

(57) ABSTRACT

The present disclosure relates to an antenna for mobile communication comprising a plurality of first radiators and at least one second radiator, which are disposed on a common reflector plane, the first radiators each including a reflector environment raised relative to the reflector plane, wherein the second radiator is disposed between a plurality of first radiators and is formed by parts of the respective reflector environment of the first radiators surrounding it.

21 Claims, 26 Drawing Sheets

(51) Int. Cl.

| | |
|---|---|
| ***H01Q 5/392*** | (2015.01) |
| ***H01Q 21/26*** | (2006.01) |
| ***H01Q 5/42*** | (2015.01) |
| ***H01Q 25/00*** | (2006.01) |
| *H01Q 5/49* | (2015.01) |

(52) U.S. Cl.
CPC ..... *H01Q 21/26* (2013.01); *H01Q 25/001* (2013.01); *H01Q 5/49* (2015.01)

(58) Field of Classification Search
CPC ..... H01Q 19/104; H01Q 9/16; H01Q 1/50; H01Q 1/36
See application file for complete search history.

(56) References Cited

U.S. PATENT DOCUMENTS

| | | | | |
|---|---|---|---|---|
| 8,199,063 | B2 | 6/2012 | Moon et al. | |
| 8,760,356 | B2 | 6/2014 | Bu et al. | |
| 2007/0146225 | A1* | 6/2007 | Boss | H01Q 21/26 343/797 |
| 2010/0171675 | A1 | 7/2010 | Borja et al. | |
| 2010/0283707 | A1 | 11/2010 | Foo | |
| 2011/0063190 | A1* | 3/2011 | Ho | H01Q 1/526 343/912 |
| 2014/0139387 | A1 | 5/2014 | Jones et al. | |
| 2018/0183134 | A1* | 6/2018 | Jan | H01Q 21/26 |

FOREIGN PATENT DOCUMENTS

| | | | |
|---|---|---|---|
| CN | 202178379 | U | 3/2012 |
| CN | 103474784 | A | 12/2013 |
| CN | 104103894 | A | 10/2014 |
| CN | 104600439 | A | 5/2015 |
| CN | 105706020 | A | 6/2016 |
| DE | 102014014434 | A1 | 3/2016 |
| EP | 2672568 | A2 | 12/2013 |
| EP | 2950385 | A1 | 12/2015 |
| EP | 3067987 | A1 | 9/2016 |
| FR | 2841390 | A1 | 12/2003 |
| FR | 2863110 | A1 | 6/2005 |
| WO | 2005055362 | A1 | 6/2005 |
| WO | 2015010760 | A1 | 1/2015 |
| WO | 2016050336 | A1 | 4/2016 |

OTHER PUBLICATIONS

Feng, B. et al., "A Differentially Driven Dual-Polarized Dual-Wideband Complementary Antenna for 2G/3G/LTE Applications," International Journal of Antennas and Propagation, vol. 2014, Article ID 480268, Jun. 2, 2014, 11 pages.
First Office Action for Chinese Patent Application No. 201710930408.2, dated Jun. 22, 2020, 27 pages.
Second Office Action for Chinese Patent Application No. 201710930408.2, dated Mar. 15, 2021, 16 pages.
Examination Report for European Patent Application No. 17193665.1, dated Apr. 9, 2021, 13 pages.
Third Office Action for Chinese Patent Application No. 201710930408.2, dated Sep. 3, 2021, 23 pages.

* cited by examiner

ANTENNA FOR MOBILE COMMUNICATION

CROSS REFERENCE TO RELATED APPLICATIONS

This application claims priority to German Patent Application No. 10 2016 011 890.3, entitled "Antenna for Mobile Communication," filed Oct. 5, 2016, the entire contents of which is hereby incorporated by reference in its entirety for all purposes.

TECHNICAL FIELD

The present disclosure relates to an antenna for mobile communication comprising a plurality of first radiators and at least one second radiator, which are disposed on a common reflector plane. The first radiator includes a reflector environment raised relative to the reflector plane. In particular, the first radiators may be high-band radiators, and the second radiator may be a low-band radiator.

BACKGROUND AND SUMMARY

It is already known to provide multi-band antennas with a plurality of low-band radiators and a plurality of high-band radiators, which are interlaced. As high-band radiators, in most cases, dipole radiators are employed. As low-band radiators, for instance, dipole squares, cross dipoles, or dipole T's are used. This is known, for instance, from U.S. Pat. No. 8,199,063 B2 and 8,760,356 B2. Using cross dipoles as low-band radiators is known from EP 2672568 A2, CN 104600439 A, and US 20140139387 A1. Further, using wide-band low-band radiators in the form of a funnel-shaped structure surrounding a first radiator is known in the art.

Using patch structures as low-band radiators is known from the publication "Differentially driven dual-polarized dual-wideband complementary antenna for 2G/3G/LTE applications", Hindawi Publishing Corporation International Journal of Antennas and Propagation, Volume 2014, Article ID480268.

A particular challenge, however, are multi-column multi-band antennas, which require in the high-band a low spatial individual radiator distance for beam forming and/or MIMO applications. The low high-band radiator distance results in that either no sufficient volume for the low-band radiator is available and/or that the low-band radiator partially covers the high-band radiators and/or modifies the directivity thereof.

It is therefore the object of the present disclosure, according to a first aspect, to provide a compact multi-band antenna, which is in particular suitable for multi-column antennas. According to a second aspect, it is the object of the present disclosure to provide a novel radiator design.

This object is achieved, in the first aspect, by an antenna for mobile communication comprising a plurality of first radiators and at least one second radiator, which are disposed on a common reflector plane, the first radiators each including a reflector environment raised relative to the reflector plane, wherein the second radiator is disposed between a plurality of first radiators and is formed by parts of the respective reflector environment of the first radiators surrounding it; and in the second aspect, by an antenna for mobile communication comprising a reflector plane and an element fed as a patch antenna disposed above the reflector plane, wherein the element fed as a patch antenna is formed by a cross-shaped metal structure. Embodiments of the present disclosure are the subject-matter of the sub-claims.

The present disclosure comprises, in a first aspect, an antenna for mobile communication comprising a plurality of first radiators and at least one second radiator, which are disposed on a common reflector plane, the first radiators each including a reflector environment raised relative to the reflector plane. It is provided that the second radiator is disposed between a plurality of first radiators and is formed by parts of the respective reflector environment of the first radiators surrounding it. By that at least a part of the reflector environment of the first radiators is excited and at the same time is used as a second radiator, a very compact configuration is obtained.

Such a first antenna can be used both individually and as a basic element for a multi-column-antenna.

In an example embodiment, the first radiators are high-band radiators, and the second radiator is a low-band radiator. In particular, therefore, the center frequency of the lowermost resonance frequency range of the first radiators is higher than the center frequency of the lowermost resonance frequency range of the second radiators. In a possible embodiment, the lowermost resonance frequency range of the first radiators may completely lie above the lowermost resonance frequency range of the second radiators.

In a possible embodiment, the reflector environment of the first radiators raised relative to the reflector plane extends at least partially in a plane extending transversely to a normal to the reflector plane and optionally substantially in parallel to the reflector plane. In particular, the parts of the reflector environment forming the second radiator extend at least partially in a plane extending transversely to a normal to the reflector plane and optionally substantially in parallel to the reflector plane. This allows a novel type of second radiator. In particular, this allows a second radiator, which can be fed in the kind of a patch antenna.

The regions extending transversely to a normal to the reflector plane and optionally substantially in parallel to the reflector plane may represent, in view of their area fraction in a plan view, the main portion of the second radiator and may have an area fraction of more than 80%.

The reflector environment of the first radiators raised relative to the reflector plane and/or the parts of the reflector environment forming the second radiator may, however, also include regions extending perpendicularly to the reflector plane.

Optionally, in a side view, the first radiators are disposed higher above the reflector plane than parts of the reflector environment forming the second radiator, in particular than the main portion of the reflector environment forming the second radiator.

Optionally, in a side view, the first radiators are disposed higher above the reflector plane than the parts of the reflector environment forming the second radiator extending transversely to a normal to the reflector plane and optionally substantially in parallel to the reflector plane. In a possible embodiment, the regions of the second radiators extending perpendicularly to the reflector plane, however, protrude in their height beyond the first radiators. In an alternative embodiment, however, also the regions of the second radiators extending perpendicularly to the reflector plane are lower than the first radiators.

In a possible embodiment of the present disclosure, the parts of the reflector environment forming the second radiator are in total lower than the first radiators.

In a plan view, in none of the embodiments just described, an overlap between the first radiators and the reflector environment and/or the parts of the reflector environment forming the second radiator is required. Optionally, in a plan view, no overlap between the first radiators and the reflector environment and/or the parts of the reflector environment forming the second radiator is provided. There are, however, also embodiments possible, wherein such an overlap is provided.

By lower-disposed second radiators, the radiation of the first radiators is only slightly impaired.

In a possible embodiment, the reflector environment of the first radiators, which is used at least partially as a second radiator, forms a reflector frame for the first radiator.

In a possible embodiment, the second radiator is disposed between four first radiators disposed in a rectangle, in particular a square. Optionally, the second radiator is disposed centrally within the rectangle formed by the first radiators. Thereby results a good symmetry of the far field.

Optionally, the parts of the reflector environment of the first radiators forming the second radiator extend out of the rectangle formed by the centers of the four first radiators. Thereby, the interlacing of the first and second radiators can be increased.

In a possible embodiment, the second radiator includes one and further optionally two symmetry axes, which may extend in parallel to the sides of the rectangle.

In particular, the second radiator formed by parts of the respective reflector environment of the first radiators surrounding it may comprise a cross-shaped metal structure, which is disposed between four first radiators disposed in a rectangle, in particular a square. Optionally, the cross-shaped metal structure extends at least partially in a plane extending transversely to a normal to the reflector plane and optionally substantially in parallel to the reflector plane.

Optionally, the center of the cross-shaped metal structure is disposed in the center of the rectangle, in particular of the square. Further, the arms of the cross-shaped metal structure may respectively extend between two first radiators.

Optionally, between the respective parts of the reflector environment of the first radiators forming a second radiator, and the respective first radiator, there is provided no additional reflector environment and/or metal structure raised above the reflector plane.

In a possible embodiment, the reflector environment of every first radiator comprises a first and a second metal structure facing each other with respect to the first radiator and being separated from each other by an interspace, wherein the first and second metal structures may form a reflector frame for the first radiator.

Optionally, the first and second metal structures extend at least partially in a plane extending transversely to a normal to the reflector plane and optionally substantially in parallel to the reflector plane.

Optionally, the first or second metal structures provided between four first radiators disposed in a rectangle, in particular a square commonly form a metal structure of a second radiator.

In a possible embodiment, the first and second metal structures each have an L-shape. The first and the second metal structures may be disposed in the form of a rectangle, in particular of a square around the first radiator.

Optionally, the legs of four L-shaped first or second metal structures together form a cross-shaped metal structure of a second radiator.

In a possible embodiment, a first polarization plane of the first radiator extends along the interspace between the first and second metal structures. Thereby, this polarization of the first radiator sees the reflector plate as a reflector environment.

Further, the first radiator may include a second orthogonal polarization plane, which may extend centrally through the first and second metal structures. In particular, the second polarization plane may form a symmetry axis of the first and second metal structures.

In a possible embodiment, the first and second metal structures each have an L-shape and are in disposed in the form of a rectangle, in particular of a square, around the first radiator, the first polarization plane of the first radiator extending diagonally between the two L-shaped metal structures, and the second orthogonal polarization plane optionally extending through the apexes of the two L-shaped metal structures.

In a preferred embodiment, the reflector environment of the first radiators includes a depression in the region of a polarization plane of the respective first radiator. Alternatively or additionally, the depression may be disposed in the region of the diagonal of a rectangle formed by the centers of the first radiators. Thereby, this polarization of the first radiator sees a larger distance to the reflector environment. Optionally, this polarization is a second polarization of the first radiator, as was described above. Optionally, the depression extends along the polarization plane and/or diagonal.

Further, the cross-shaped metal structure described above may include a depression in the region of its diagonal. Alternatively or additionally, the first and second L-shaped metal structures described above may include a depression in the region of their diagonal. Optionally, the depression is disposed in a polarization plane of a first radiator and may extend along the polarization plane.

Optionally, the depression forms a region of the reflector environment, which extends transversely to the normal to the reflector plane. In particular, the reflector environment therefore extends in the region of the depression inclinedly to the normal to the reflector plane and inclinedly to the reflector environment.

Optionally, behind the depression follow regions of the reflector environment, which substantially extend in parallel to the reflector environment. In particular, the arms of the cross-shaped metal structure and/or the legs of the L-shaped metal structure substantially extend in parallel to the reflector environment.

In another possible embodiment, the parts of the reflector environment of the first radiators forming the second radiator are fed in the region of the diagonal of a rectangle formed by the centers of the first radiators and/or in the region of the diagonal of the cross-shaped metal structure forming the second radiator.

Further, the parts of the reflector environment forming the second radiator may include slots in the region of the diagonal, said slots optionally extending along the diagonal and/or being bridged by webs.

In particular, the cross-shaped metal structure of the second radiator is fed in the region of its diagonal and/or includes slots in the region of its diagonal, said slots optionally extending along the diagonal and/or being bridged by webs.

In another possible embodiment, the parts of the reflector environment of the first radiators forming the second radiator and in particular the cross-shaped metal structure includes an opening in its center, in the region of the opening an adjustment structure being provided, if applicable.

In a possible embodiment, the parts of the reflector environment of the first radiators forming the second radiator and in particular the cross-shaped metal structure and/or the first and the second L-shaped metal structures consist of one or a plurality of sheet-metal parts. The cross-shaped metal structure may include a single-piece or multi-piece basic element stamped and folded from sheet metal, which unites four L-shaped metal structures.

In another possible embodiment, the parts of the reflector environment of the first radiators forming the second radiator and in particular the cross-shaped metal structure and/or the first and the second L-shaped metal structures comprise regions extending in parallel to the reflector plane, these regions optionally extending in parallel to the sides of a rectangle formed by the centers of the first radiators and/or in the region of the legs of the cross-shaped metal structure and/or of the first and the second L-shaped metal structures.

Between the legs of the L-shaped metal structures preferably one bridge region each is provided, which connects the legs to each other. This bridge region may include a depression, optionally a depression as described above. In particular, the depression may be lowered relative to the regions extending in parallel to the reflector plane.

In another possible embodiment, the parts of the reflector environment of the first radiators forming the second radiator and in particular the cross-shaped metal structure and/or the first and the second L-shaped metal structures include frame elements extending perpendicularly to the reflector plane and forming a vertical reflector frame for the first radiators.

In a possible embodiment, the first radiators are dipole radiators, in particular dual-polarized dipole radiators, in particular dual-polarized crossed dipoles. The dipole elements of the dipole radiators may be disposed via a socket on a common reflector.

Optionally, the dipole elements the dipole radiators include a larger distance to the reflector than the parts of the reflector environment forming the first radiator.

In another possible embodiment, the second radiator is fed as a patch antenna.

In another possible embodiment, the second radiator is a dual-polarized radiator, the polarization planes of the second radiator optionally extending along the diagonal of the cross-shaped metal structure and/or of the rectangle formed by the first radiators.

In a possible embodiment, the first radiators include a distance of the individual radiators of $0.5\lambda$ to $0.7\lambda$ wherein $\lambda$ is the wavelength of the center frequency of the lowermost resonance frequency range of the first radiators. Therefore, this is an extremely compact configuration of first radiators.

In another possible embodiment, the first radiators include a distance to the reflector plane between $0.15\lambda$ and $0.6\lambda$ wherein $\lambda$ is the wavelength of the center frequency of the lowermost resonance frequency range of the first radiators.

In a possible embodiment, the plurality of first radiators respectively include the same reflector environment and/or the same resonance frequency ranges and/or the same orientation of the polarization planes and/or the same structure.

Further, an antenna according to the present disclosure may include a plurality of second radiators, which respectively have the same resonance frequency ranges and/or the same orientation of the polarization planes and/or the same structure.

In a possible embodiment, the antenna includes at least two second radiators, which have different resonance frequency ranges and/or a different structure, preferably a first radiator being disposed between the two second radiators and including a reflector environment, which consists of at least two different parts, and in particular comprises two L-shaped metal structures with a different leg length.

The antenna according to the present disclosure is in particular suitable as a basic element for creating antenna arrays. Optionally, therein a plurality of first antennas, as described above, are disposed side by side in one or a plurality of columns and/or rows.

In a possible embodiment, the antenna according to the present disclosure includes a first antenna array formed by a plurality of first radiators with a plurality of columns and rows and a second antenna array formed by a plurality of second radiators with at least one column and/or row, the second radiators respectively being formed by parts of the reflector environment of the first radiators surrounding them.

In a possible embodiment, the second antennas are disposed in at least two rows and/or columns, the radiators of which are offset relative to each other, and/or the radiators of which have different resonance frequency ranges and/or a different structure.

In a second aspect, the present disclosure comprises an antenna for mobile communication with a reflector plane and an element fed as a patch antenna and disposed above the reflector plane. It is provided that the element fed as a patch antenna is formed by a cross-shaped metal structure. Thereby, a novel antenna differing from the usual geometry of patch antennas is provided.

In a possible embodiment, the cross-shaped metal structure includes a distance to the reflector plane changing along its extension.

In particular, the cross-shaped metal structure may include a depression in the region of its diagonal, the depression optionally extending along the polarization plane.

Further, the cross-shaped metal structure may comprise regions extending in parallel to the reflector plane, these regions optionally extending in the region of the arms of the cross-shaped metal structure.

Further, the cross-shaped metal structure may include regions extending perpendicularly to the reflector plane, which further may extend along the median plane of the four arms of the cross-shaped metal structure.

In a possible embodiment, the cross-shaped metal structure is fed in the region of its diagonal. The feed can occur, e.g., asymmetrically at one feed point on the diagonal or symmetrically at two feed points on the diagonal, which are facing each other with respect to the center the cross-shaped metal structure, wherein the symmetrical feed can occur in a serial or parallel manner.

In another possible embodiment, the cross-shaped metal structure includes slots in the region of its diagonal, said slots optionally extending along the diagonal and/or being bridged by webs.

In another possible embodiment, the cross-shaped metal structure may include an opening in its center, in the region of the opening an adjustment structure being provided, if applicable.

Optionally, the cross-shaped metal structure forms a dual-polarized radiator, wherein the polarization planes of the dual-polarized radiator may extend along the diagonal of the cross-shaped metal structure.

The cross-shaped metal structure may consist of one or a plurality of sheet-metal parts, the cross-shaped metal structure optionally including a single-piece or multi-piece basic element stamped and folded from sheet metal, which comprises the four arms of the cross-shaped metal structure and optionally includes a recess in its center.

The antenna according to the second aspect may also be employed independently of the first aspect. Optionally, the cross-shaped metal structure of the antenna according to the second aspect forms, however, a second radiator according to the first aspect.

Optionally, the cross-shaped metal structure of the antenna according to the second aspect is designed and/or disposed, as described above in more detail in view of the first aspect. Alternatively or additionally, the second radiator of an antenna according to the first aspect may be embodied, as has been described for the antenna according to the second aspect.

The antennas according to the present disclosure optionally are antennas for mobile communication, as they are employed for mobile communication base stations.

The present disclosure further comprises a mobile communication base station with at least one antenna for mobile communication, as described above.

DETAILED DESCRIPTION OF THE FIGURES

Figure 1:
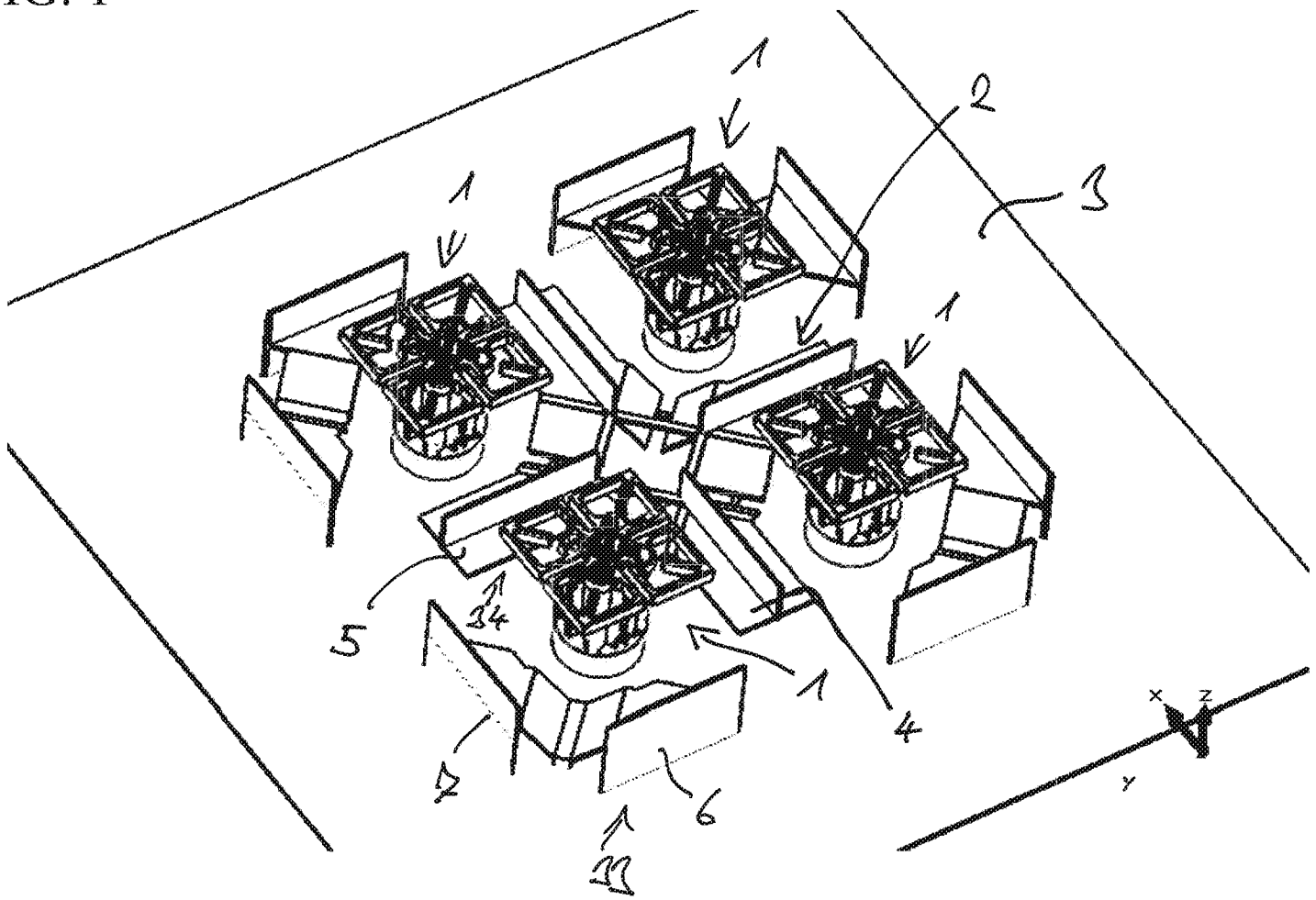
FIG. 1 shows a first embodiment of an antenna for mobile communication, which shows the first and the second aspects of the present disclosure in a combination.

FIG. 1 shows an embodiment of an antenna for mobile communication according to the present disclosure, wherein both the first aspect and the second aspect of the present disclosure are embodied.

According to the first aspect, the antenna comprises four first radiators 1, the reflector environment of which at is least partially used for forming a second radiator 2, which is disposed between the four first antennas 1. First radiators 1 are disposed on a common reflector plate 3. The reflector environment of the first radiators forming second radiator 2 is raised relative to this reflector plate 3. In particular, the reflector environment, of which at least parts are employed as a second radiator, forms a reflector frame for the first radiators.

First radiators 1 may be high-band radiators, second radiator 2 is a low-band radiator. In particular, the center frequency of the lowermost resonance frequency range of the first radiators is above the center frequency of the lowermost resonance frequency range of the second radiator.

This solution allows an extremely compact configuration, which is in particular suitable as a basic element for multi-band antennas with a plurality of columns and/or rows.

Another advantage of the present disclosure is that first radiators 1 are disposed higher above reflector plate 3 than the reflector environment forming second radiator 2, so that the radiation of the first radiator is not or only slightly impaired by the reflector environment or second radiator 2.

In the embodiment, dipole radiators are employed as first radiators 1. In particular, they are dual-polarized dipole radiators.

In the embodiment, the dipole radiators include a socket, by means of which the dipoles are disposed on reflector plate 3. The socket carries two dipole elements for every dipole. The dipole elements of the dipole radiators extend in a plane in parallel to reflector plate 3, and are held via the socket in a certain distance above reflector plate 3. The socket further includes, in the embodiment, a symmetrization, which carries the dipole elements forming the dipoles. In particular, the symmetrization comprises carrier elements for the dipole elements, which extend perpendicularly to reflector plate 3, and which are separated from each other by slots. Every carrier element carries a dipole element.

In the embodiment, the dipoles are crossed dipoles with two dipoles disposed in a cross-shaped manner for the two orthogonal polarizations. The symmetrization comprises four carrier elements, which carry one dipole element each, wherein dipole elements opposite over the central axis form a dipole.

For the purpose of the present disclosure, however, other constructions for the first radiators are also conceivable, in particular also other constructions of dual-polarized dipoles.

The reflector environment of first radiators 1 raised relative to reflector plate 3 consists of two L-shaped structures 33 or 34, legs 6 and 7 or 4 and 5 of which respectively form a side of a reflector frame surrounding first radiator 1.

The L-shaped structures of the reflector environment disposed between the first radiators commonly form second radiator 2. In particular, the four L-shaped structures disposed between the four first radiators 1 form a cross-shaped structure of the second radiator. Legs 4 and 5 of the L-shaped structures of two adjacent first radiators extend in parallel to each other. An arm of the cross-shaped metal structure of the second radiator is therefore formed by two parallel legs of two adjacent L-shaped metal structures of the reflector environment of the first radiators.

The L-shaped structures disposed on the outside in FIG. 1 have, in this embodiment, the only role of a reflector environment for first radiators 1, and do not form any second radiators. In other embodiments, these parts of the reflector environment can, however, be employed as parts of second radiators.

In the embodiment, the four first radiators are disposed in a rectangle, in particular in a square. In particular, the centers of the four first radiators form a rectangle. The cross-shaped structure forming the second radiator includes four arms, which extend centrally and perpendicularly to the four sides of this rectangle or square. In the embodiment, the arms extend out of the rectangle formed by the four centers of the first radiators. This means that the extension of the second radiator in parallel to the sides of the rectangle formed by the first radiators is larger than the distance between two first radiators.

The respective L-shaped structures, which commonly form the cross-shaped structure of the second radiator, may be conductively connected to each other. The connection may be achieved galvanically and/or capacitively. In possible embodiments, the L-shaped structures commonly forming the cross-shaped structure of the second radiator may be formed in one piece. Alternatively, the cross-shaped structure of the second radiator may consist of a plurality of separate portions. These portions can correspond to the L-shaped structures. There is, however, also conceivable a separation of the cross-shaped structure of the second radiator into a plurality of separate portions, which do not match the L-shaped structures.

The reflector environment of the first radiators and/or the second radiator may be formed by one or a plurality of metal structures. In particular, such a metal structure can consist of one or a plurality of sheet-metal parts. Making it from a conductively coated plastic material or of one or a plurality of circuit-board elements is also conceivable.

The reflector environment of the first radiators or the second radiator, respectively, may be made from one or a plurality of sheet-metal parts. In particular, the sheet-metal parts may be stamped and bent sheet metal.

In a possible embodiment, all elements of the cross-shaped metal structure of a second radiator may be formed by a continuous, stamped and bent sheet-metal part. Alternatively, the second radiators consist of a plurality of sheet-metal parts and can capacitively and/or galvanically be coupled to each other. A capacitive coupling may for instance occur by an overlap of two sheet-metal parts.

The polarization planes of the dual-polarized first radiators are oriented, in the embodiment, diagonally relative to the rectangle or square formed by the first radiators.

The reflector frame of a first radiator formed by the respective reflector environment is open along a first polarization, i.e. along a first diagonal. This means that the respective legs of the two L-shaped metal structures forming a reflector environment are facing each other with an interspace. Further, the L-shaped metal structures include a depression in the region of their apexes, i.e. the reflector environment of the first radiators is lowered in the region of the second polarization, i.e. along the second diagonal. The specific embodiment of the reflector environment in view of this aspect will be explained in detail below.

In the following, first the embodiment of second radiator 2 will be described in more detail. This second radiator 2 may, according to the second aspect of the present disclosure, also be employed independently of first radiators 1 and independently of its embodiment by parts of the reflector environment of first radiators.

According to the second aspect, the second radiator is formed by a cross-shaped metal structure 2, which extends above a reflector plate 3, and is fed as a patch antenna. As is described in the following in more detail, for this purpose, the cross-shaped metal structure can electrically be coupled to a first conductor and reflector plate 3 can electrically be coupled to a second conductor of a signal line. In particular, the signal line is a coax line, wherein the internal conductor is electrically coupled to the cross-shaped metal structure, and the external conductor is electrically coupled to reflector plate 3. Alternatively, an aperture-coupled feed, e.g., by slots is also conceivable.

Figure 2:
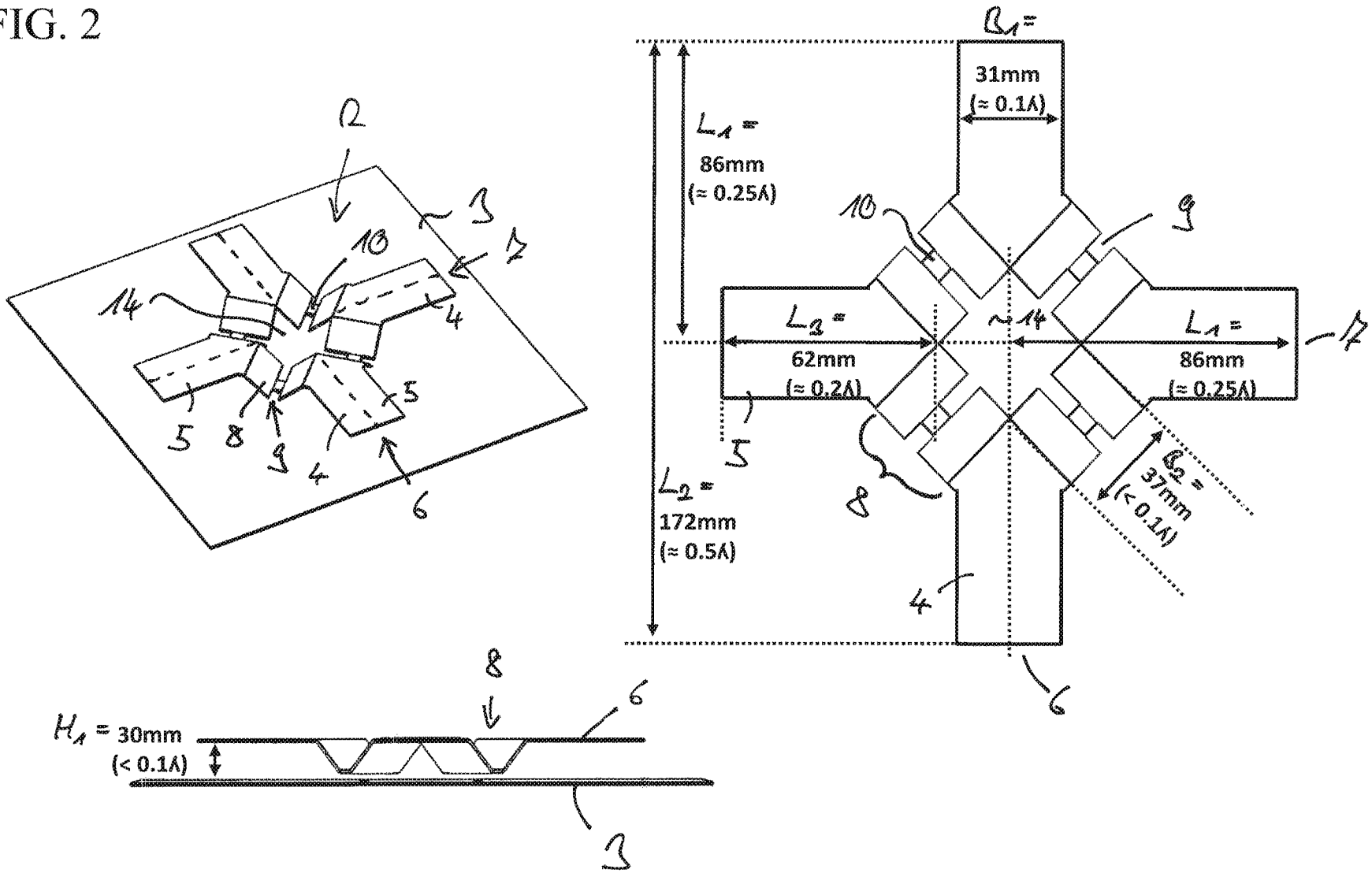
FIG. 2 shows an embodiment of an antenna for mobile communication according to the second aspect of the present disclosure with an element fed as a patch antenna in the form of a cross-shaped metal structure.

In FIG. 2, a cross-shaped metal structure 2 is shown, which is disposed on a reflector plate 3 and can be employed according to the first aspect as a second radiator formed by the reflector environment of first radiators, and also according to the second aspect independently of such first radiators and their reflector environment.

The cross-shaped metal structure includes four arms 6 and 7, which extend in a cross-shaped manner.

In a possible embodiment of the present disclosure, all four arms of the cross-shaped metal structure are galvanically connected to each other and form a continuous metal structure. In alternative embodiments, the arms can, however, also be formed by separate metal structures, which are not galvanically connected to each other.

In the embodiment, the cross-shaped metal structure includes an inner opening 14. Adjacent arms of the cross-shaped metal structure are connected by bridges, which surround inner opening 14.

The cross-shaped structure further includes slots 9 in the region of its diagonal or of the bridges. The slots extend, in the embodiment, along the diagonal, and extend, in the embodiment, from inner recess 14 as well as from outside into the bridges disposed between the arms.

In the embodiment, slots 9 are bridged by webs 10. In an alternative embodiment, webs 10 could, however, also be omitted.

Optionally, the feed occurs in the region of slots 9 and/or webs 10. This is shown in the following in more detail.

Arms 6 or 7 of the cross-shaped metal structure include, in the embodiment, one region each, which extends in parallel to reflector plate 3 in a certain distance above this plate.

The cross-shaped metal structure includes, in the embodiment, depressions 8 in the region of its diagonal, said depressions extending along the diagonal. In particular, the arms of the cross-shaped metal structure extend in parallel to reflector plate 3, whereas the bridges connecting the arms have a V-shape. The role of this depression is in particular important for the first aspect of the present disclosure, and is shown in the following in more detail.

In the embodiment, the opposing arms are configured mirror-symmetrically relative to a centrally extending symmetry plane. In the embodiment, the cross-shaped metal structure includes four symmetry planes, one each that extends centrally through and parallel to the arms, and one each that extends along the diagonal of the cross.

In FIG. 2, the symmetry planes, which extend centrally and in parallel to arms 6 and 7, are drawn in broken lines. When employed according to the first aspect, these also represent the separation into the L-shaped structures of the respective reflector environments of the first radiators surrounding the second radiator. This separation of the cross-shaped metal structure of the second radiator into L-shaped structures needs, however, not necessarily be made structurally. In the embodiment shown in FIG. 2, rather, the two legs of the L-shaped metal structures forming an arm of the cross-shaped metal structure are formed in one piece.

In the following, a possible dimensioning of the cross-shaped metal structure shown in FIG. 2 is given. There are, however, also other dimensionings conceivable.

Arms 6 or 7 of the cross-shaped metal structure include a region, which extends in parallel to reflector plate 3 in a certain distance above this plate. In the embodiment, this height $H_1$ preferably is between 0.05 and 0.3λ, further optionally between 0.05λ and 0.2λ. Optionally, the height $H_1$ is 0.1λ.

The width $B_1$ of arms 6 or 7 may be between 0.05λ and 0.3λ, further optionally between 0.05λ and 0.2λ, and in particular 0.1λ.

The arms may have, starting from the center of the structure, a length $L_1$ between 0.15λ and 0.35λ, optionally between 0.2λ and 0.3λ, in particular 0.25λ.

In the embodiment, the cross-shaped metal structure includes an inner opening 14. The latter may have a minimum diameter between 0.05λ and 0.2λ, and in particular a minimum diameter of 0.1λ. The length $L_3$ of the arms starting from this inner recess 14 may be between 0.1λ and 0.4λ, in particular 0.2λ.

The total length $L_2$ of the cross-shaped metal structure along the arms may be between 0.3λ and 0.7λ, in particular between 0.4λ and 0.6λ, and optionally 0.5λ.

Adjacent arms of the cross-shaped metal structure are connected by bridges, the width $B_2$ of which, in the embodiment, is between 0.05λ and 0.2λ, and in particular is 0.1λ.

λ is the wavelength of the center frequency of the lowermost resonance frequency range of the second radiator.

By the cross-shaped metal structure of the second radiator, a dual-polarized radiator is also provided. This is shown in more detail in the following with reference to FIGS. 3 and 4.

Figure 3:
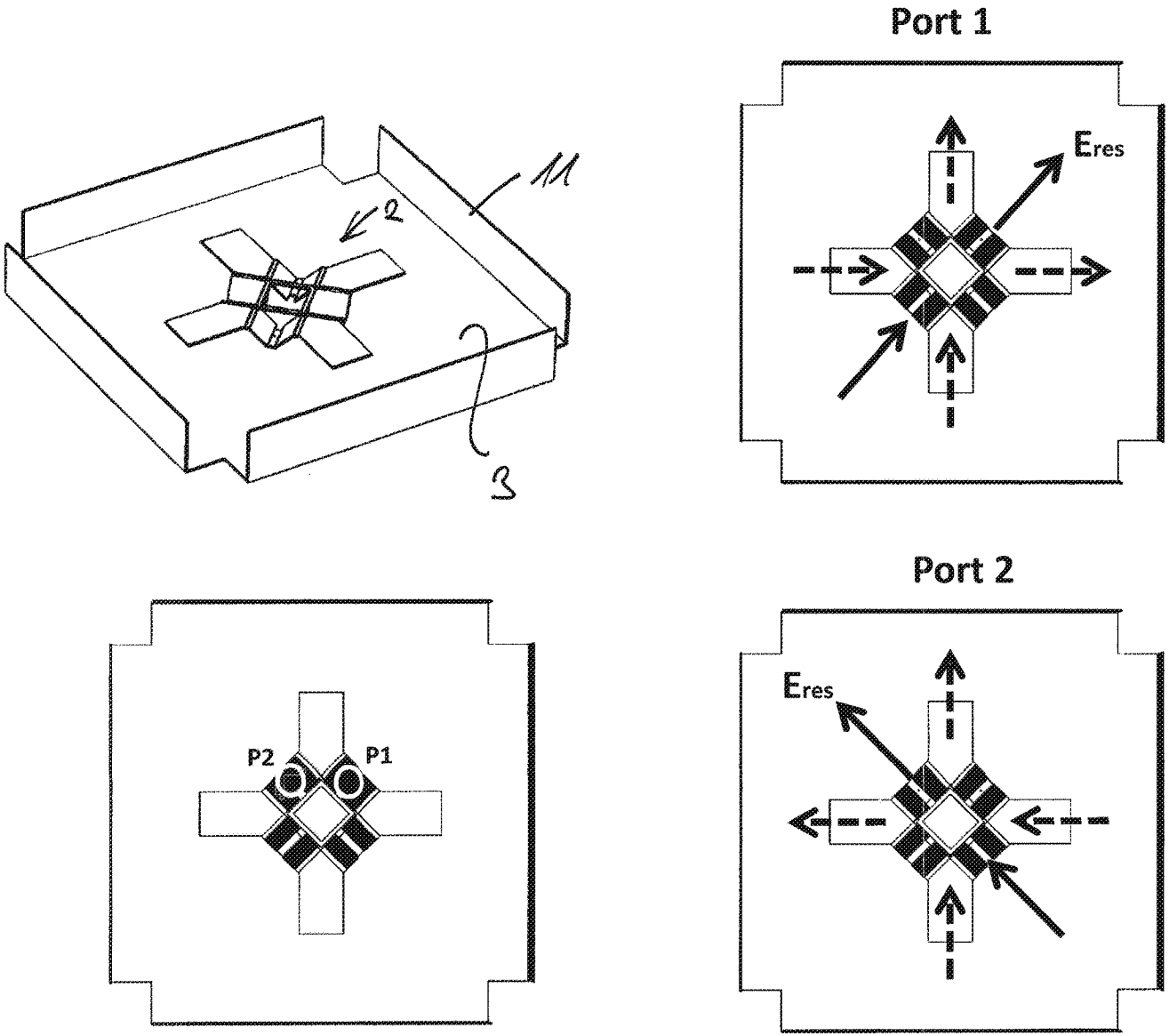
FIG. 3 shows a variant of the antenna for mobile communication shown in FIG. 2 with a principle representation of the feed of the two polarizations.

FIG. 3 shows at top left a second radiator formed by the cross-shaped metal structure 2. In FIG. 3 is further shown, besides reflector plate 3, on which the cross-shaped metal structure 2 is disposed, a reflector frame 11 for the second radiator, which, however, not necessarily needs to be provided.

The representation in FIG. 3 at bottom left shows the feed of the cross-shaped metal structure in the region of the diagonal. The cross-shaped metal structure includes two ports P1 and P2, by means of which the two orthogonal polarizations of the radiator are fed.

The representation at top right shows the first polarization generated by the feed of port 1, with the resulting vector of the E-field $E_{res}$ of this first polarization being shown. FIG. 3 at bottom right shows the orthogonal polarization fed by port 2 and the respective E-field vector $E_{res}$. The two polarizations of the second radiator extend diagonally to the arms of the cross-shaped metal structure.

Figure 4:
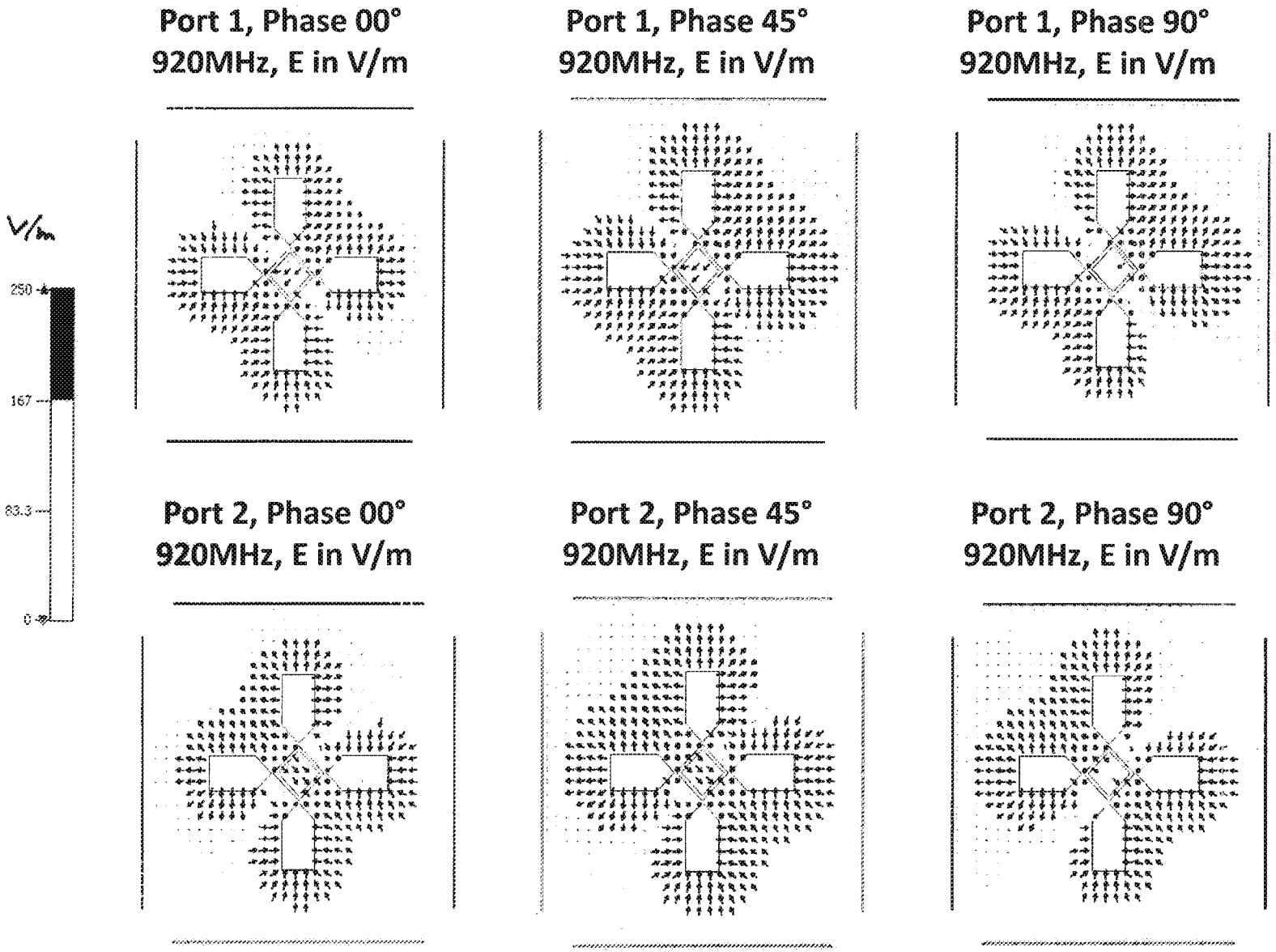
FIG. 4 shows diagrams, which show the E-field of the antenna shown in FIG. 3 for different phases for the two ports and for a frequency of 920 MHz.

The two representations in FIG. 3 at top right and bottom are pure principle representations. The diagrams in FIG. 4 show, however, corresponding simulation results for the resulting E-field for different phases. In the upper row, the diagrams for a feed of first port 1, in the lower row, the diagrams for a feed of second port 2 are shown.

Figure 5A:
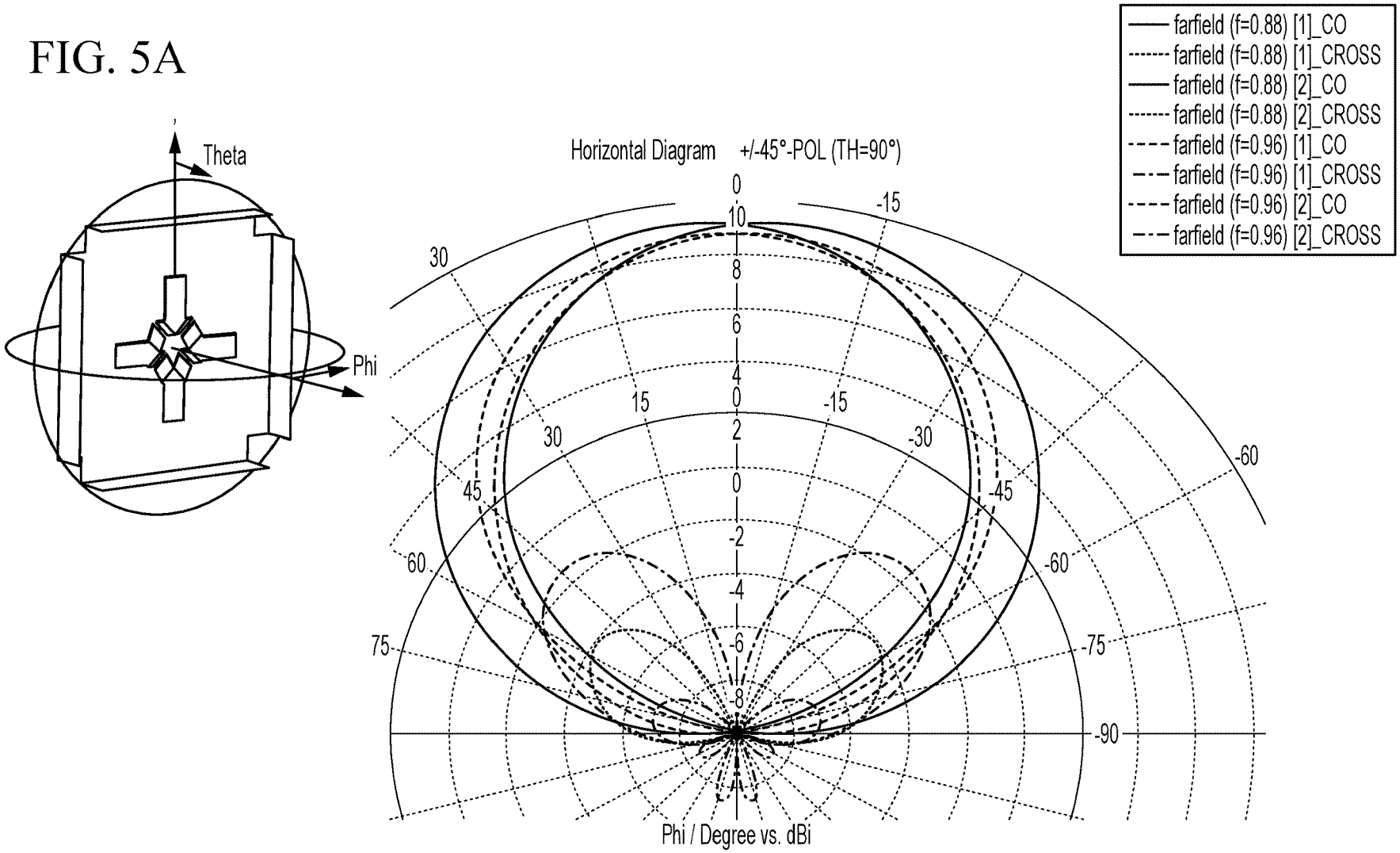
FIG. 5A shows simulated far field values of the antenna shown in FIG. 3 in a horizontal diagram for the two polarizations.
Figure 5B:
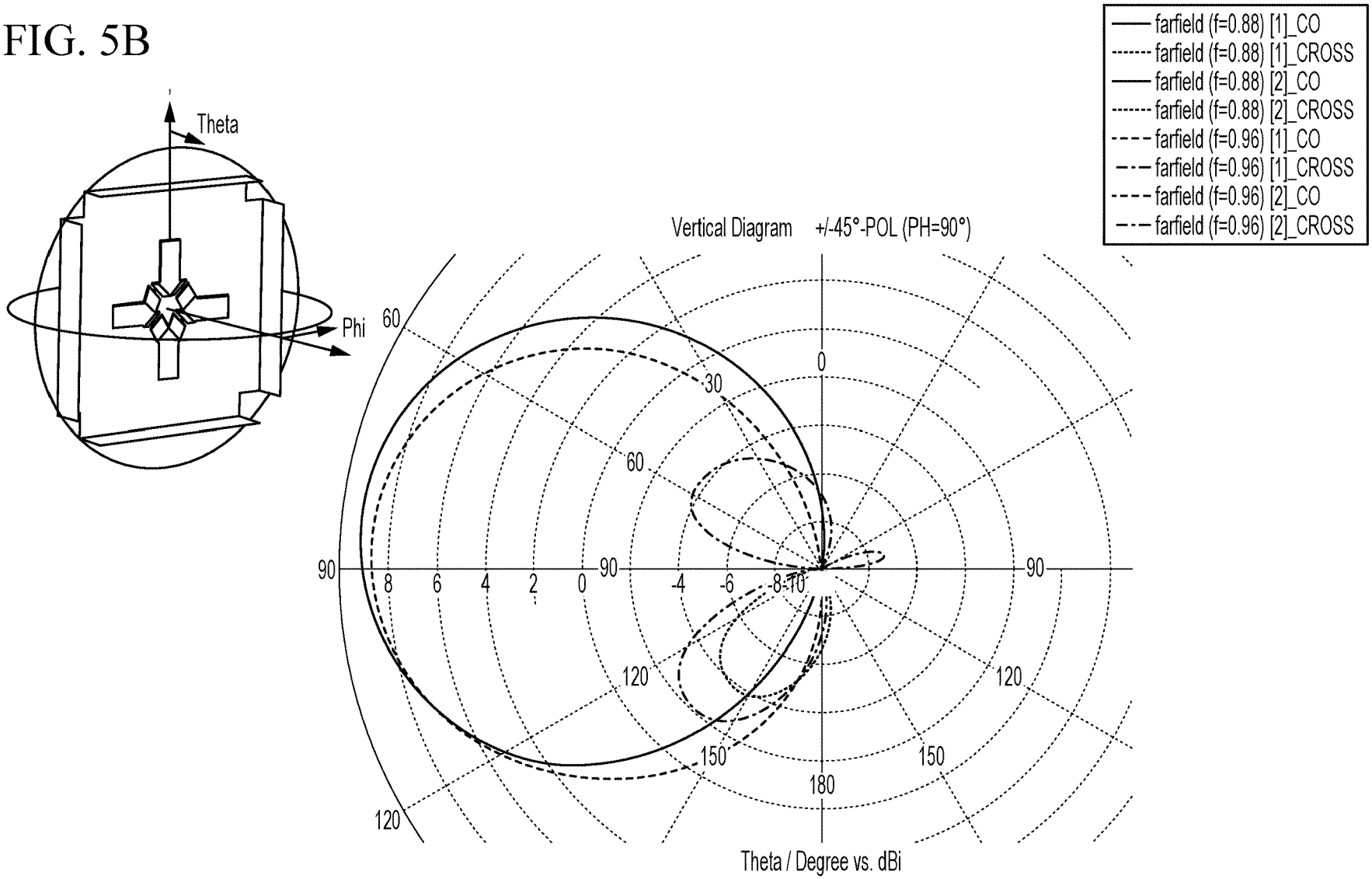
FIG. 5B shows simulated far field values of the antenna shown in FIG. 3 in a vertical diagram for the two polarizations.

FIG. 5A shows the corresponding horizontal diagram for the two polarizations. The far field for polarization 1 and 2 is drawn for a frequency of 880 MHz, and for a frequency of 960 MHz. There is shown the co-polarization as well as the crossed polarization. FIG. 5B shows the corresponding vertical diagram for the two polarizations, again the co-polarization and the crossed polarization for the frequencies of 880 MHz and 960 MHz being drawn. The two diagrams show the good symmetry of the two polarizations.

Figure 6:
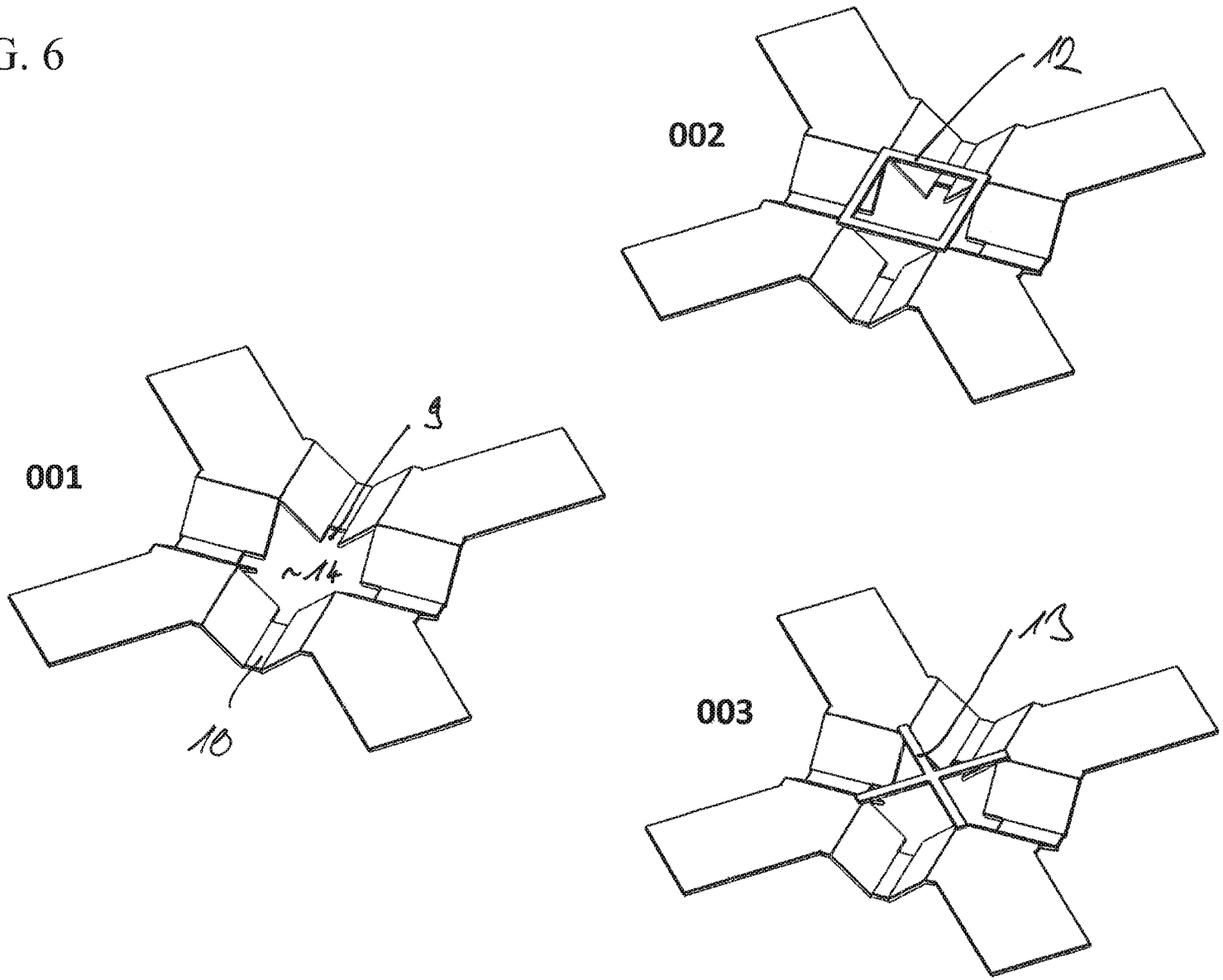
FIG. 6 shows one variant without and two variants with a central element for the cross-shaped element fed as a patch antenna.

FIG. 6 shows three variants of a cross-shaped metal structure. They differ in view of the embodiment of the metal structure in the region of inner opening 14.

The variants 002 and 003 each show a central element which is disposed in the region of inner opening 14. Both central elements are disposed at the level of the arms of the metal structure and connect the inner ends of the arms to each other. Central element 12 in version 002 forms a frame for inner opening 14. Central element 13 in version 003 is, however, cross-shaped, and connects the inner ends of the arms over inner opening 14. In version 001 there is, however, no central element provided.

In all three versions, a sheet-metal structure is employed as the cross-shaped metal structure, which consists of one or a plurality of stamped and bent sheet-metal parts. Inner opening 14 is therefore formed by a corresponding recess in the sheet-metal structure. Central elements 12 and 13 are conductive elements placed on this sheet-metal structure, in particular also sheet-metal structures. The central element may capacitively and/or galvanically be attached at the sheet-metal structure. In an alternative embodiment, it would be conceivable to integrate the central element in the structure.

Figure 7A:
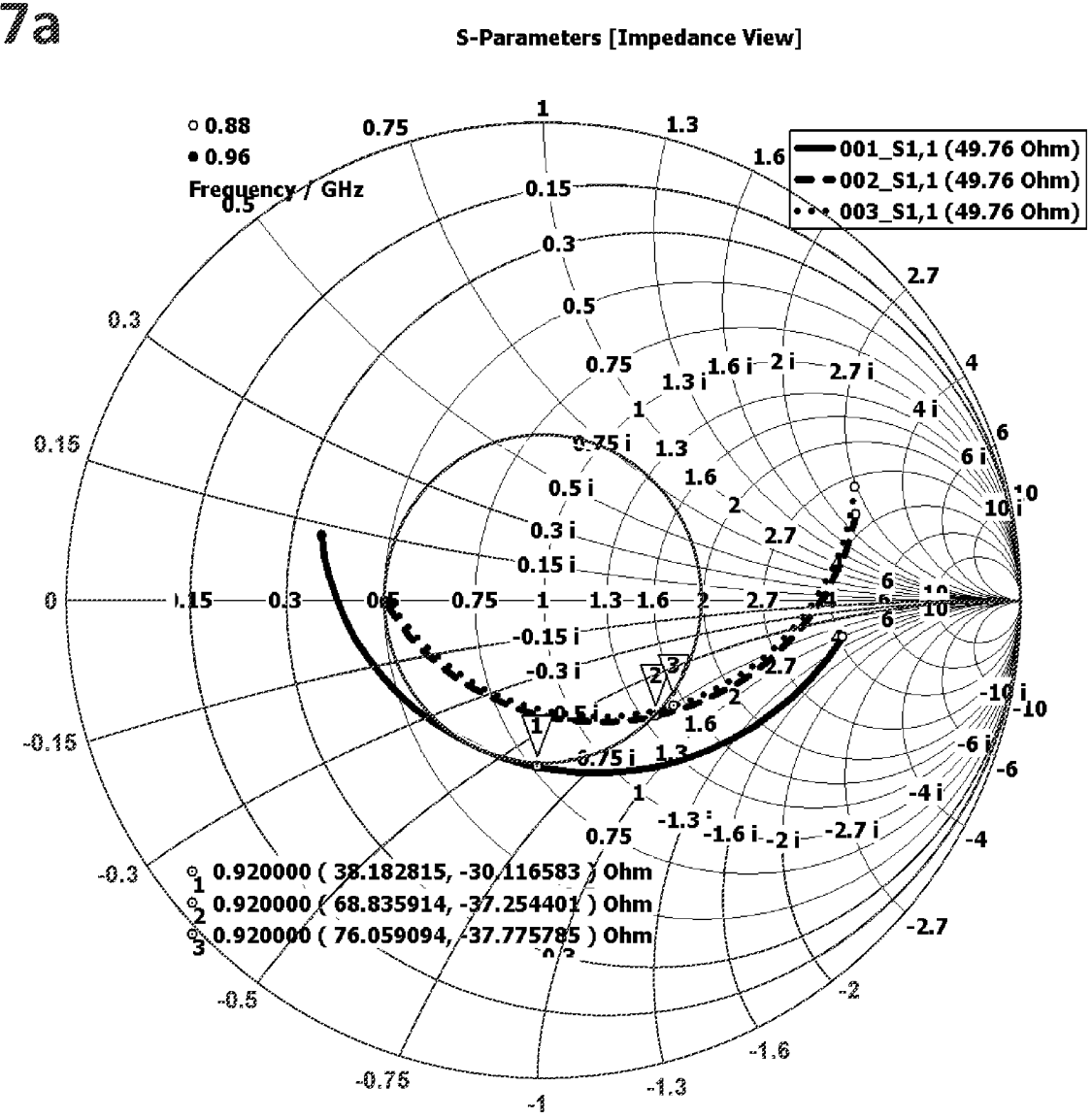
FIG. 7A shows a Smith chart of three variants shown in FIG. 6 for the frequency range between 880 MHz and 960 MHz.
Figure 7B:
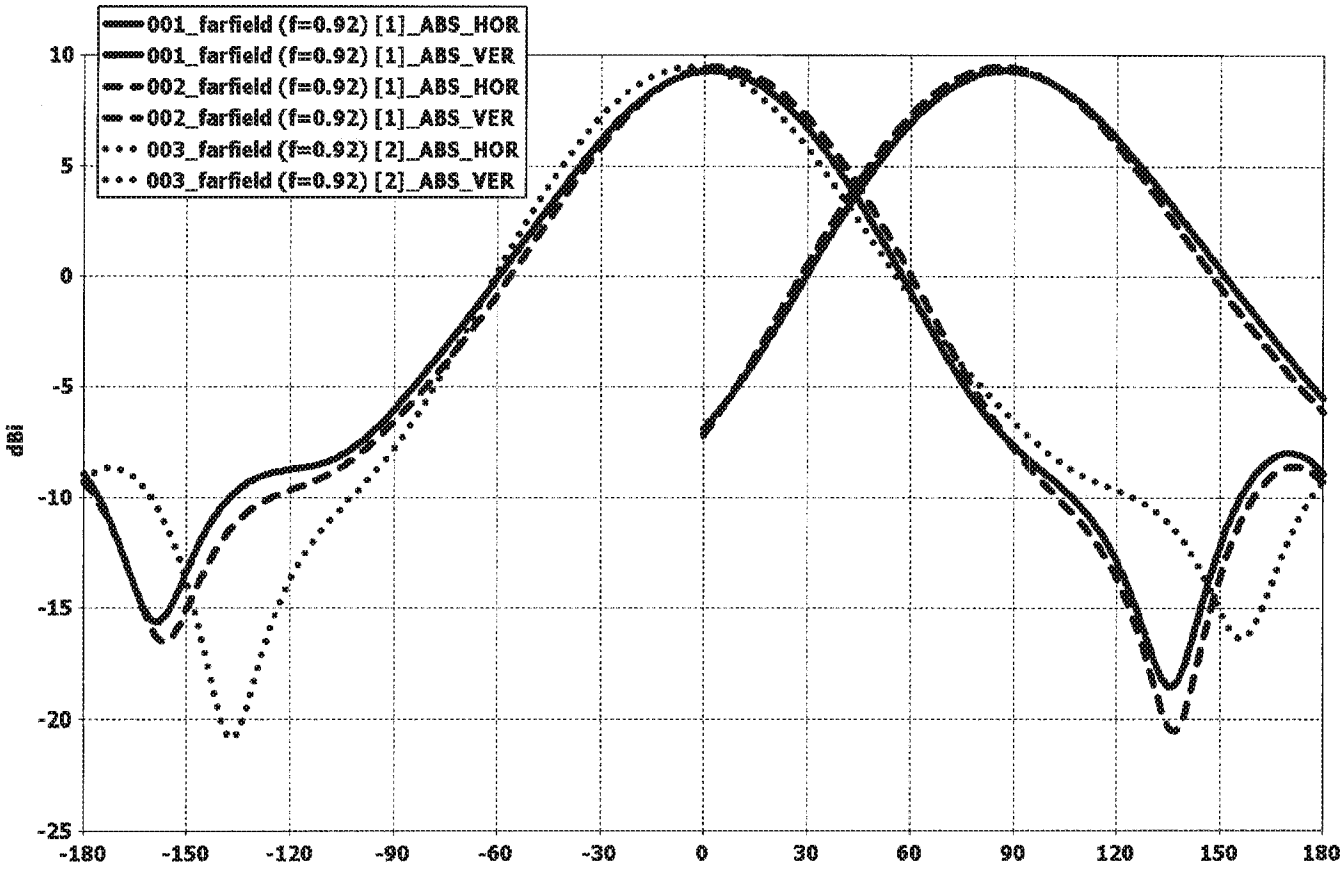
FIG. 7B shows a diagram of the absolute values of the far field in the horizontal and vertical directions for a frequency of 920 MHz for the three variants shown in FIG. 6.

FIG. 7A shows the S-parameter of the three variants of FIG. 6 in a Smith chart, FIG. 7B shows the absolute values of the far field in the horizontal and vertical directions. As FIGS. 7A and 7B clearly show, all three versions have similar S-parameters and far field properties. Depending of the employed environment and in particular for a use according to the first aspect, depending of the environment by first radiators, one or the other version may be advantageous. For instance, the central element can be used for decoupling the first radiators and/or for shaping the far field diagram of the first radiators.

Figure 8:
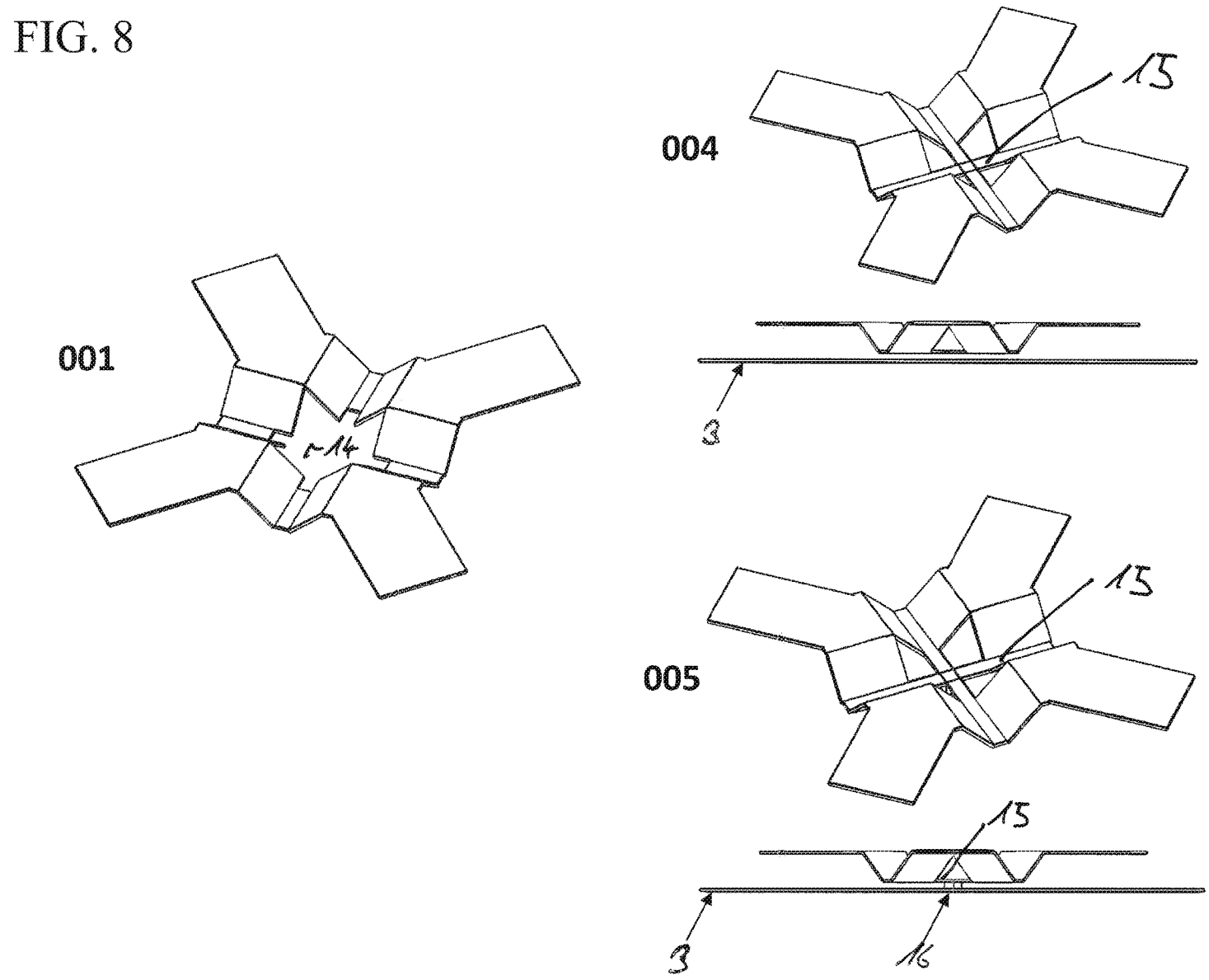
FIG. 8 shows one variant without and two variants with a central element disposed in the region of the feed.

FIG. 8 shows three further variants of a cross-shaped metal structure. In version 001, the center of the radiator is again left free. In the variants 004 and 005, however, in the region of inner opening 14, a bottom segment 15 is employed, which connects the bridges disposed between the arms to each other. Bottom segment 15 is disposed on the lowermost plane of the depression, and extends in particular in a cross-shaped manner along the diagonal.

In variant 004, the cross-shaped metal structure of the second radiator is electrically insulated relative to reflector plate 3 and is therefore not conductively connected thereto. In variant 005, however, a short-circuit to the reflector in the region of the center of the radiator occurs through bottom segment 15. The short-circuit to the reflector can for instance occur via a socket 16, which connects reflector plate 3 to bottom segment 15.

Figure 9A:
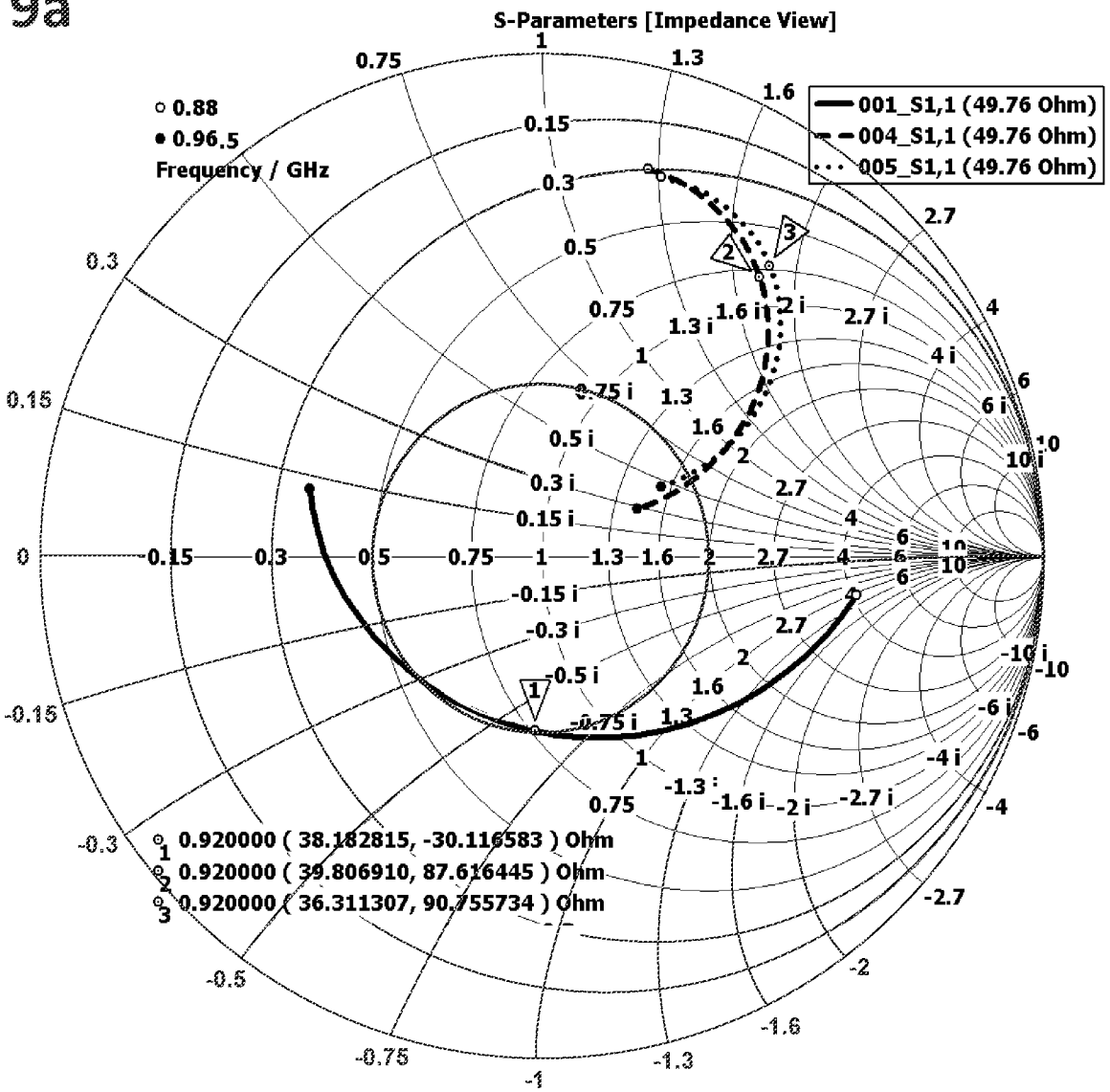
FIG. 9A shows a Smith chart of the three variants shown in FIG. 8 for the frequency range between 880 MHz and 965 MHz.
Figure 9B:
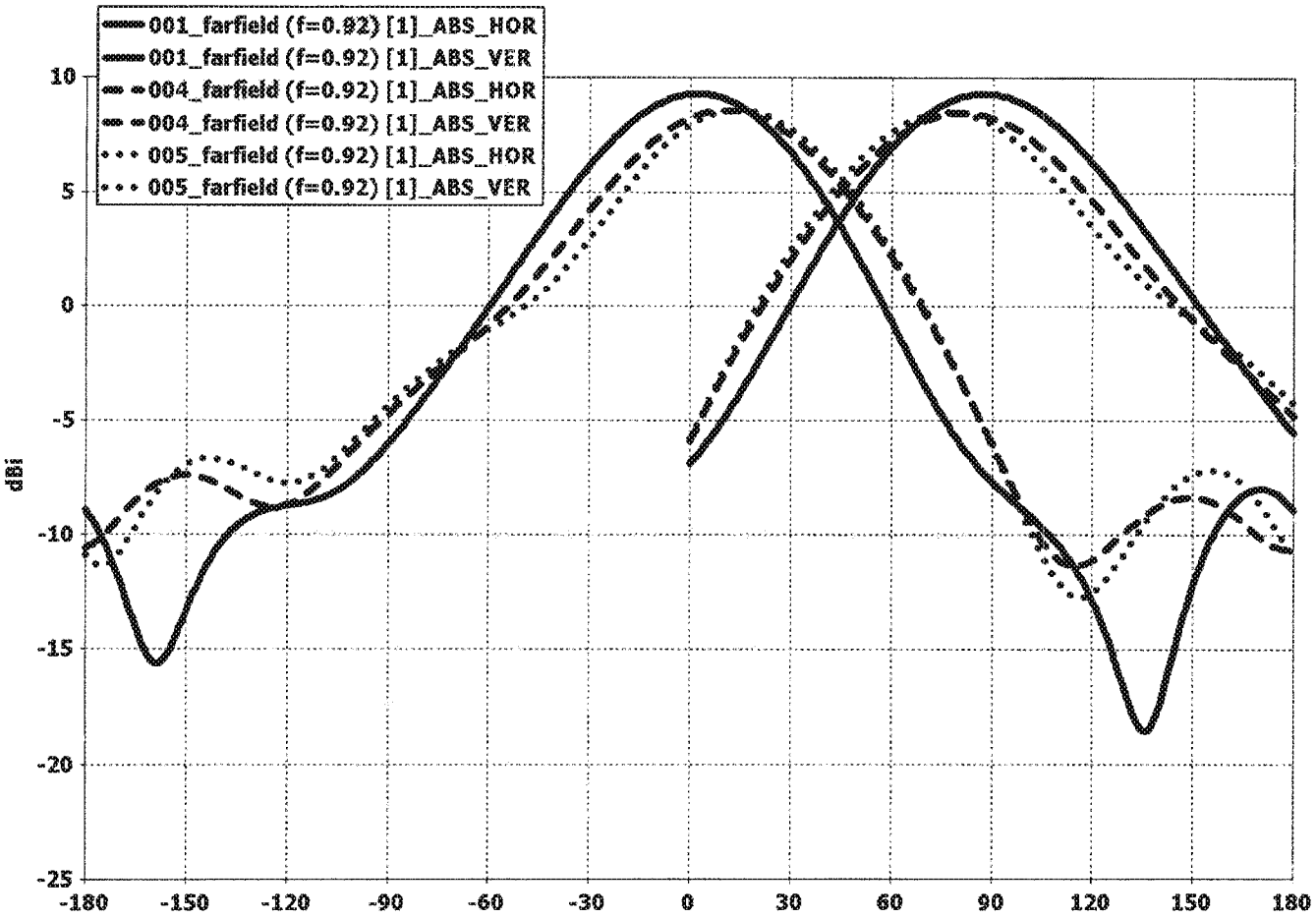
FIG. 9B shows a diagram of the absolute values of the far field in the horizontal and vertical directions for a frequency of 920 MHz for the three variants shown in FIG. 8.

FIG. 9A shows the S-parameter in a Smith diagram, and FIG. 9B shows the absolute values of the far field in the horizontal and vertical directions, each for the three versions shown in FIG. 8. All versions have similar S-parameters and far field properties.

Depending of the environment and in particular for a use according to the first aspect, depending of the environment with first radiators, one or the other version may be advantageous. The bottom segment can also be used for decoupling the first radiators and/or for shaping the far field diagram of the first radiators.

The feed of the cross-shaped metal structure occurs, as also briefly described above, as for a patch antenna. The second radiator according to the present disclosure differs, however, from a conventional patch antenna in view of the shape of the radiator, and in particular in view of the cross-shaped metal structure with an indentation and/or depression in the feed region. Further, version 005 clearly also differs from a conventional patch antenna by the short-circuit to the reflector.

As already shown above, the feed of cross-shaped structure 2 occurs in the region of its diagonal, i.e. in the region of bridges 8 connecting the arms. In particular, the feed occurs in the region of slots 9 extending along the diagonal or of webs 10 bridging these slots.

Figure 10:
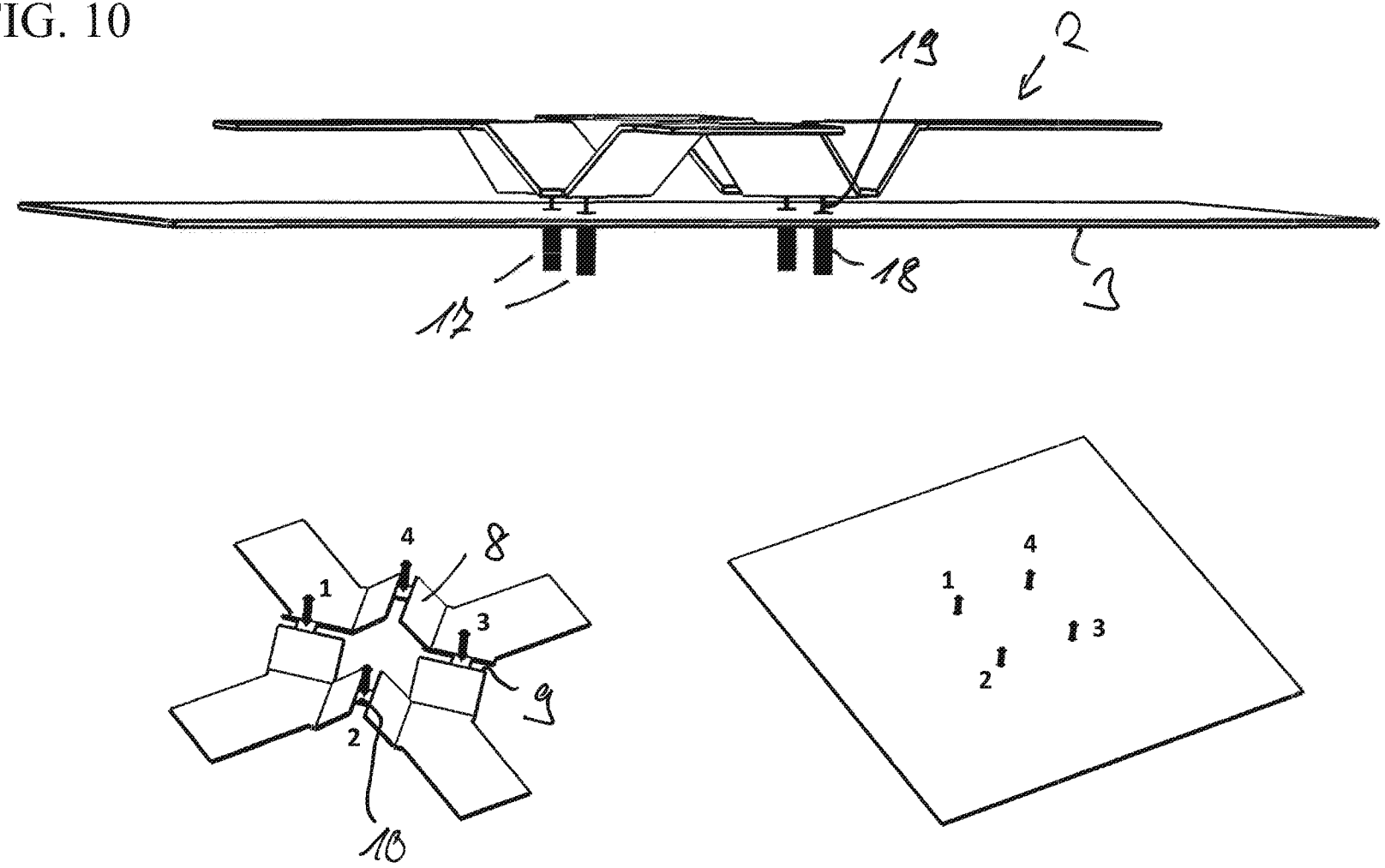
FIG. 10 shows four possible feed points as well as a possible embodiment of the feed of the element fed as a patch antenna in the form of a cross-shaped metal structure.

FIG. 10 shows possible embodiments of such a feed. As shown in FIG. 10, there exist four possible feed points 1 to 4. Feed points 1 and 3 or 2 and 4 diagonally opposing each other respectively correspond to the same polarization of the radiator and can therefore be employed alternatively or commonly for the feed of this polarization.

The feed in the embodiment occurs via coax cables 17. External conductor 18 of coax cables 17 is electrically connected to reflector plate 3, internal conductor 19, however, is electrically connected to the feed point of the cross-shaped metal structure. In the embodiment shown in FIG. 10, internal conductor 19 of the coax cable is galvanically connected to a web 10. The feed can, however, also occur in a different way, for instance by a capacitive coupling and/or by a transition from coax cable to printed circuit board, the printed circuit board being capacitively or galvanically connected to the radiators. In particular, for the second radiator, aperture-coupled patches are also conceivable, wherein the feed can asymmetrically or symmetrically occur, for instance by two orthogonal slots.

Figure 11:
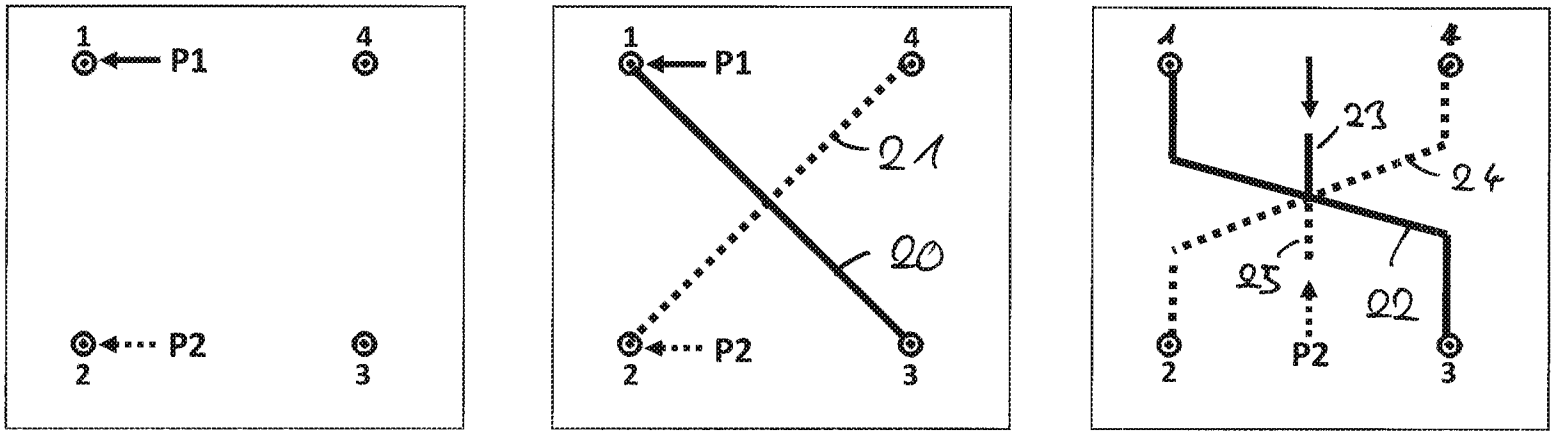
FIG. 11 shows three principle representations showing an asymmetrical feed, a symmetrical feed with series connection, and a symmetrical feed with parallel connection.

FIG. 11 shows three possible variants of the feed of the two polarizations via the four feed points to be selected.

On the left in FIG. 11 is shown an asymmetrical feed, wherein only the two feed points 1 and 2 serve as ports, whereas feed points 3 and 4 are not used. The advantage of this embodiment resides in a low complexity and in a low materials input. However, thus a moderate field symmetry and a lower port decoupling only is achieved.

The middle representation in FIG. 11 shows a symmetrical feed, wherein the two feed points 2 and 4 or 1 and 3, respectively, are serially connected to each other and are therefore commonly used as port P2 or P1. The advantage of such an embodiment is the high field symmetry and good port decoupling. The embodiment is, however, relatively narrow-band, since the serial connection leads to that feed points 1 and 3 or 2 and 4, respectively, have exactly the same phase for one frequency only.

On the right in FIG. 11 is shown a symmetrical parallel feed. Ports 1 and 3 or 2 and 4, respectively, are connected in parallel and are used as port P1 or P2, respectively. Thereby, the problems with the narrow-band occurring with a serial feed are prevented, and nevertheless a good field symmetry and port decoupling is achieved. However, this embodiment is also provided with an increased complexity and/or a higher materials input.

The serial or parallel connection of the feed points optionally occurs by a distribution network. The latter may be realized, for instance, by coax cables with corresponding connectors between the individual portions of the coax cables. There are, however, also other embodiments of a feed network conceivable.

Figure 12:
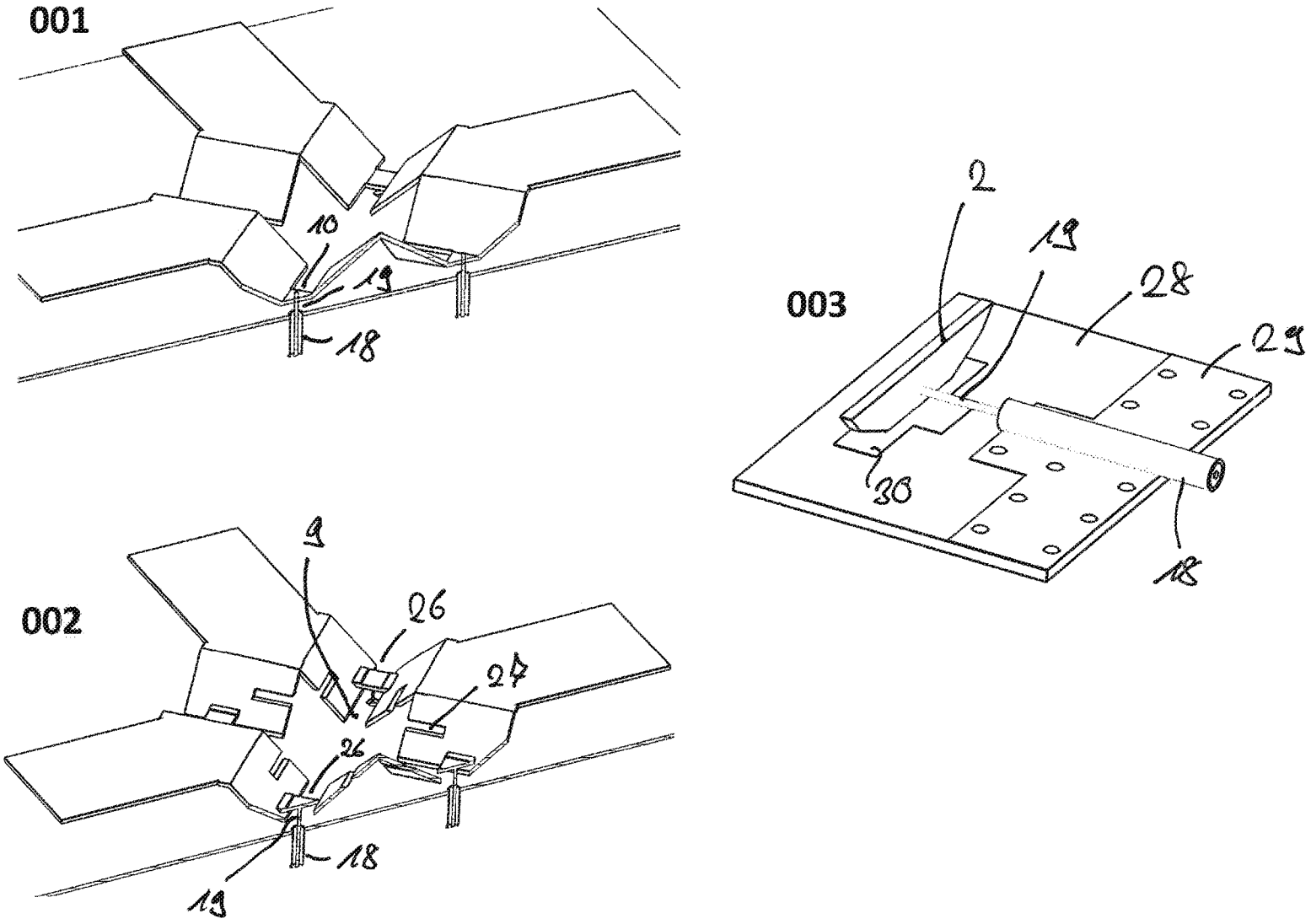
FIG. 12 shows three variants for the feed.

FIG. 12 shows a possible structural embodiment of the feed in three variants. Version 001 shows again the feed, as it is used in FIG. 10. External conductor 18 is coupled to reflector plate 3, internal conductor 19 is coupled to web 10. Coupling occurs galvanically.

In version 002, coupling between internal conductor 19 and the metal structure occurs, however, capacitively. In this embodiment, there are no webs 10 provided, but only slots 9. The capacitive coupling occurs in the region of slots 9 via coupling elements 26, which are electrically connected to the ends of internal conductor 19 and are disposed at a small distance only to the two elements of the cross-shaped metal structure limiting slot 9. The coupling therefore occurs in the region of the depression. Further, additional side slots 27 are provided in the region of the depression. By such an embodiment, for instance, the decoupling between the ports can be affected.

In version 003, a printed circuit board 28 is employed, which is disposed between the radiator and the reflector. FIG. 12 shows a portion of the cross-shaped metal structure 2 only, whereas the remaining parts of the cross-shaped metal structure and the reflector are omitted. The printed circuit board can, for instance, be connected to the reflector by spread rivets. External conductor 18 of the coax cables is electrically connected to a metallized region 29 of the printed circuit board, which in turn establishes the electrical connection to the reflector. Internal conductor 19 is coupled to the cross-shaped structure, for instance in the region of webs 10. Printed circuit board 28 includes another metallized region 30, which is capacitively or galvanically connected to the cross-shaped metal structure. Coupling of internal conductor 19 can occur immediately with the metal structure, or via a metallization 30. The connection of external conductor 18 to the reflector through the printed circuit board optionally occurs capacitively.

The printed circuit board has the advantage that a part of the adjustment can occur on the printed circuit board.

A cross-shaped metal structure, as it was described in more detail with reference to FIGS. 2 to 12, can per se be employed, according to the second aspect, as a radiator, in particular as a low-band radiator.

According to the first aspect, however, the cross-shaped metal structure may be formed by parts of the reflector environment of first radiators, which surround the second radiator formed by the cross-shaped metal structure. All features of the cross-shaped metal structure, which were described for an antenna according to the second aspect, can therefore also be employed for the second radiator of an antenna according to the first aspect.

In the following, preferred features of the first aspect of the present disclosure, which can be employed in combination, but also independently of the second aspect, are explained in more detail.

The focus of the first aspect of the present disclosure is that the reflector environment of a first radiator is at least partially excited and used as a part of a second radiator. In particular, the first radiator is a high-band radiator, the second radiator is a low-band radiator.

A characteristic feature is the depression of the reflector environment of the first radiators in one of the two polarization planes of the first radiators, and/or the feed of the second radiator in the region of these polarization planes.

The depression increases the metal distance between the parts of the first radiators, which form the first polarization, and the reflector environment, and thus leads to a similar radiation between the first polarization and the second polarization of the first radiator.

In an example embodiment, the reflector environment of the first radiators and/or the second radiator may be made from sheet-metal parts. All elements can be stamped and bent from one part, or consist of a plurality of parts and can capacitively and/or galvanically be coupled. In particular, a capacitive coupling by overlap is conceivable.

Figure 13:
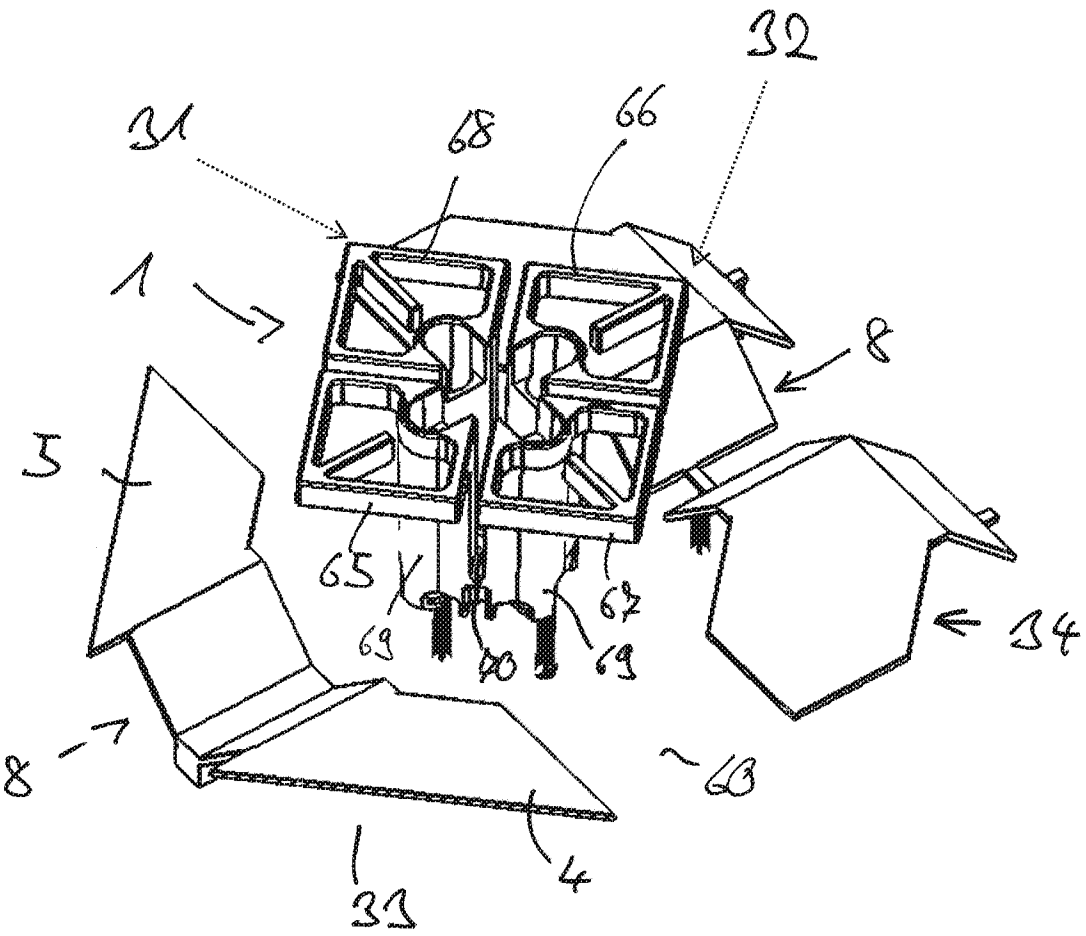
FIG. 13 shows a first radiator and its reflector environment for an antenna according to the first aspect of the present disclosure.

FIG. 13 shows an embodiment of a first radiator 1 with its reflector environment, which is employed, according to the first aspect of the present disclosure, at least partially as a component of the second radiator.

The first radiators are, in the embodiment, dual-polarized dipole radiators of a first dipole 31 and a second dipole 32. First dipole 31 is formed by two dipole elements 67 and 68, second dipole 32 orthogonally disposed thereto is formed by two dipole elements 65 and 66. The dipole elements extend in a plane in parallel to reflector plate 3 and are held by the socket in a certain distance to this reflector plate. The socket comprises a symmetrization with support elements 69, which are separated from each other by slots 70 and each of which carries one of dipole elements 67 and 68.

In the embodiment, the dual-polarized dipole has a square base area, wherein the two dipoles or the polarizations thereof extend along the diagonal of the square. The present disclosure is, however, also conceivable with differently configured first radiators and in particular with differently configured dual-polarized dipole radiators as first radiators. E.g., the dipole head of the first radiator may be round or have a cross shape rather than a square or include open ends rather than closed ends.

The reflector environment of first radiator 1 consists of two L-shaped structures 33 and 34. These are raised relative to the reflector plate not shown in FIG. 13, and form a reflector frame for the first dipole.

Each of the two L-shaped structures comprises two legs 4 and 5, which respectively form one side of the reflector frame. The two polarizations of the first radiator extend along the diagonal of the reflector frame formed by L-shaped structures 33 and 34. In the embodiment, legs 4 and 5 of the two L-shaped structures 33 and 34 extend in parallel to a side edge of the square basic form of first radiator 1.

The two L-shaped structures 33 and 34 do not form a closed reflector frame. Rather, there remains an interspace 60 between the ends of the opposing legs of the L-shaped structures. The reflector frame is therefore open along the first diagonal. Along this diagonal extends the first polarization plane of the first radiator, which is generated, in the embodiment, by first dipole 31.

In the region of their apexes, L-shaped structures 33 and 34 include one depression 8 each. The depression thus is located in the region of the second diagonal, along which the second polarization of the first radiator extends, which is generated, in the embodiment, by second dipole 32.

This embodiment has as a consequence that both polarizations of first radiator 1 see approximately the same metal environment or the same metal distance between the dipole head and the environment. The first polarization, which is formed by first dipole 31, sees the reflector bottom. Second polarization 32 sees, because of depression 8, a similar environment.

L-shaped structures 33 and 34, in the embodiment, in the region of their apexes do not reach the apex. Rather, the legs of L-shaped structures 33 and 34 end before the apex and are connected by bridges 8 forming the depression and extending in a certain distance to the apex.

The depression needs not have a particular shape. The depression can for instance be formed by an indentation. The latter may also have a round cross-section instead of a funnel or V-shaped cross-section.

Figure 14:
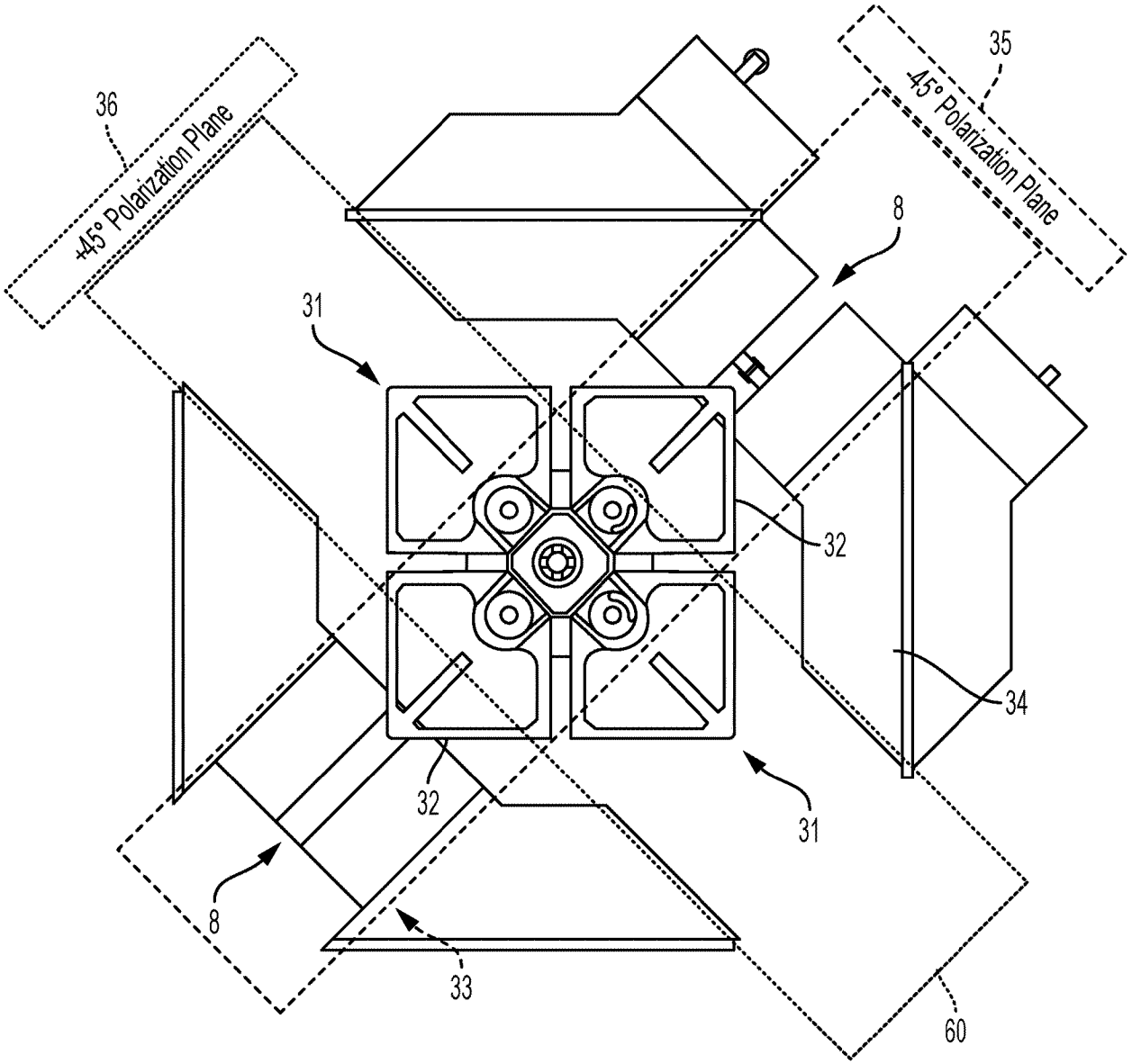
FIG. 14 shows a principle representation of the location of the polarization planes for the embodiment shown in FIG. 13.

The relationship between the polarization planes and the metal environment is again schematically shown in FIG. 14. First polarization plane 36, which corresponds to the +45-degree polarization generated by first dipole 31, sees reflector plate 30 because of interspace 60 between L-shaped structures 33 and 34. Second polarization plane 35, which corresponds to the −45-degree polarization generated by second dipole 32, sees depression 8 in the region of the L-shaped structures.

As the embodiment shows, for the embodiment of the L-shaped structures, substantially the configuration of the two legs 4 and 5, the interspace between the L-shaped structures as well as the depression in the region of the apex are relevant.

In the region of the apex, the two legs 4 and 5 are connected to each other by a bridge 8. Bridge 8 includes the depression. The ratio between the width of the bridge or depression 8 perpendicular to the diagonal and the width of the interspace 60 perpendicular to the respective diagonal may be between 1 to 3 and 3 to 1, further optionally between 1 to 2 and 2 to 1, further optionally between 1 to 1.5 and 1.5 to 1.

Figure 15:
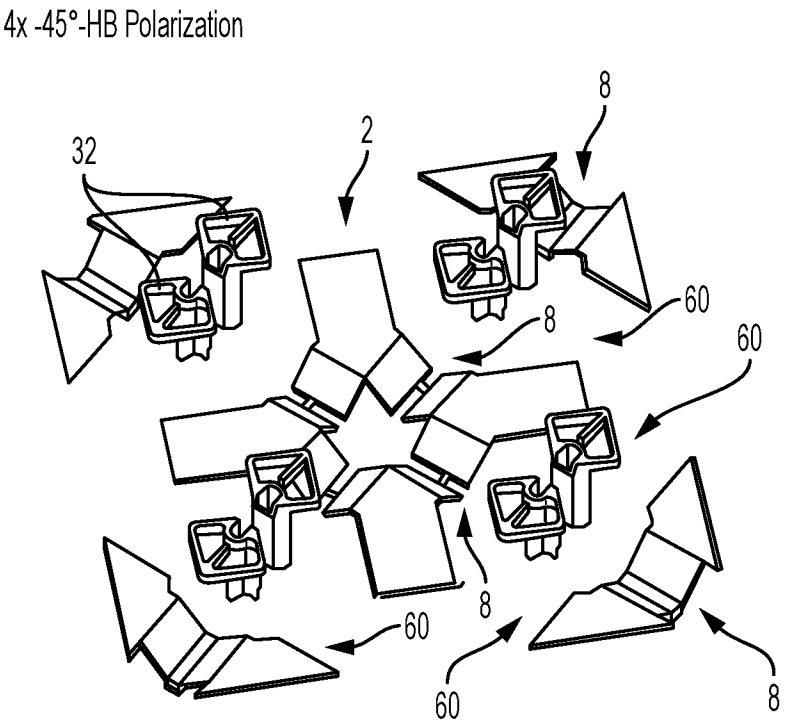
FIG. 15 shows two representations of an antenna according to the first aspect of the present disclosure comprising four first radiators and the reflector environment thereof forming a second radiator, only the dipoles of the first antennas for one of the two polarization directions being shown.
Figure 15:
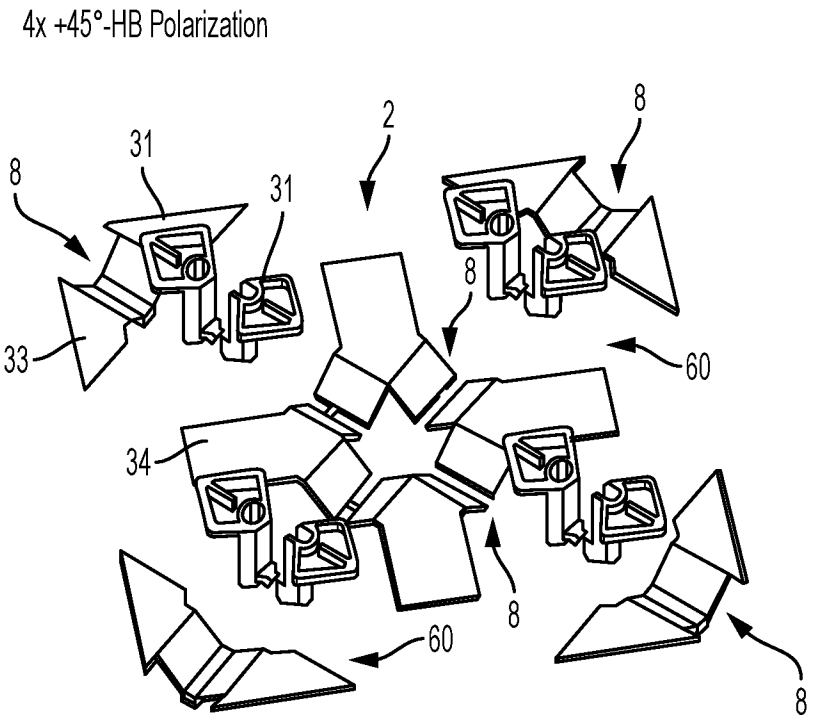

FIG. 15 shows an antenna according to the first aspect of the present disclosure, which is formed by four first radiators and the reflector environment thereof, as they are basically shown in FIG. 14. The respectively inner L-shaped structures 34 of the four first radiators commonly form a cross-shaped metal structure of the second radiator.

In FIG. 15 is employed, for the L-shaped metal structures forming the second radiator, a geometric embodiment slightly different from in FIG. 14. In particular, the end of the legs of the L-shaped metal structure are rectangular, whereas it is pointed in FIG. 14. Both variants are equivalent.

In FIG. 15 are drawn on the left only first dipoles 31 for the +45-degree polarization, on the right only second dipoles 32 for the −45-degree polarization. As can clearly be seen in FIG. 15, two of the four dipoles of identical polarization see interspaces 60, and two of the four dipoles see depression 8 of the reflector environment surrounding them.

In the embodiments shown in FIGS. 13 and 15, legs 4 and 5 of the L-shaped structures are configured as plates extending in parallel to the reflector plane, and bridges 8 connecting them as depressions.

Figure 16:
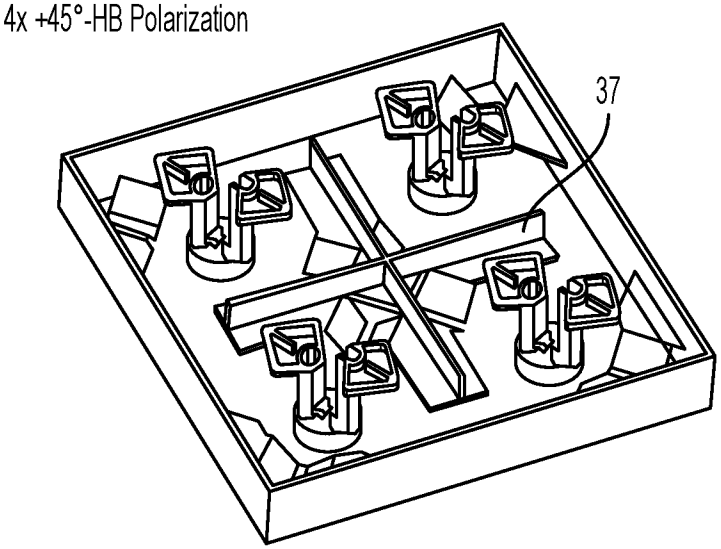
FIG. 16 shows a variant of the first radiator shown in FIG. 13 or of the antenna shown in FIG. 15.
Figure 16:
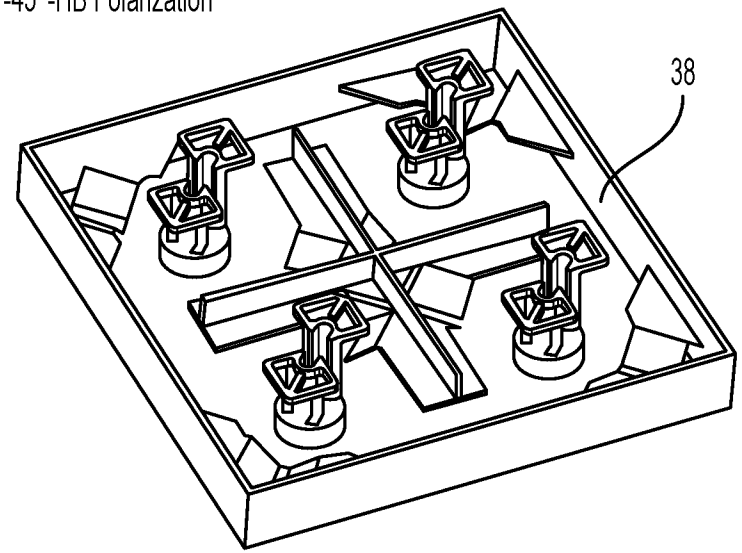
Figure 16:
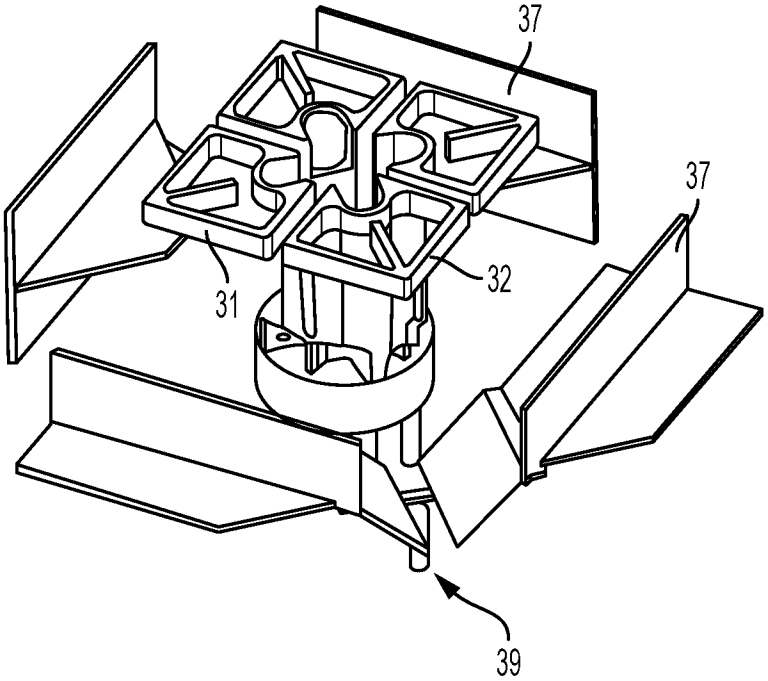

In the embodiments shown in FIG. 16, the arms additionally include frame elements 37 extending in the vertical direction.

In the embodiment shown in FIG. 16 on the left, frame elements 37 extend only in the region of the legs, not, however, in the region of the apexes of the L-shaped structures.

The frame elements can, however, also extend in the region of the apex, as shown on the right. In view of the second radiator, which is formed by the L-shaped structures disposed between the four first radiators, the frame elements can be connected beyond opening 14, and for instance form a continuous cross. The inner part of the frame elements thus corresponds to a central element already described above.

When the first radiators are not employed in a larger array, wherein the outer L-shaped structures also serve as second radiators, the respective frame elements 37 can be connected to a larger frame 38.

Figure 17:
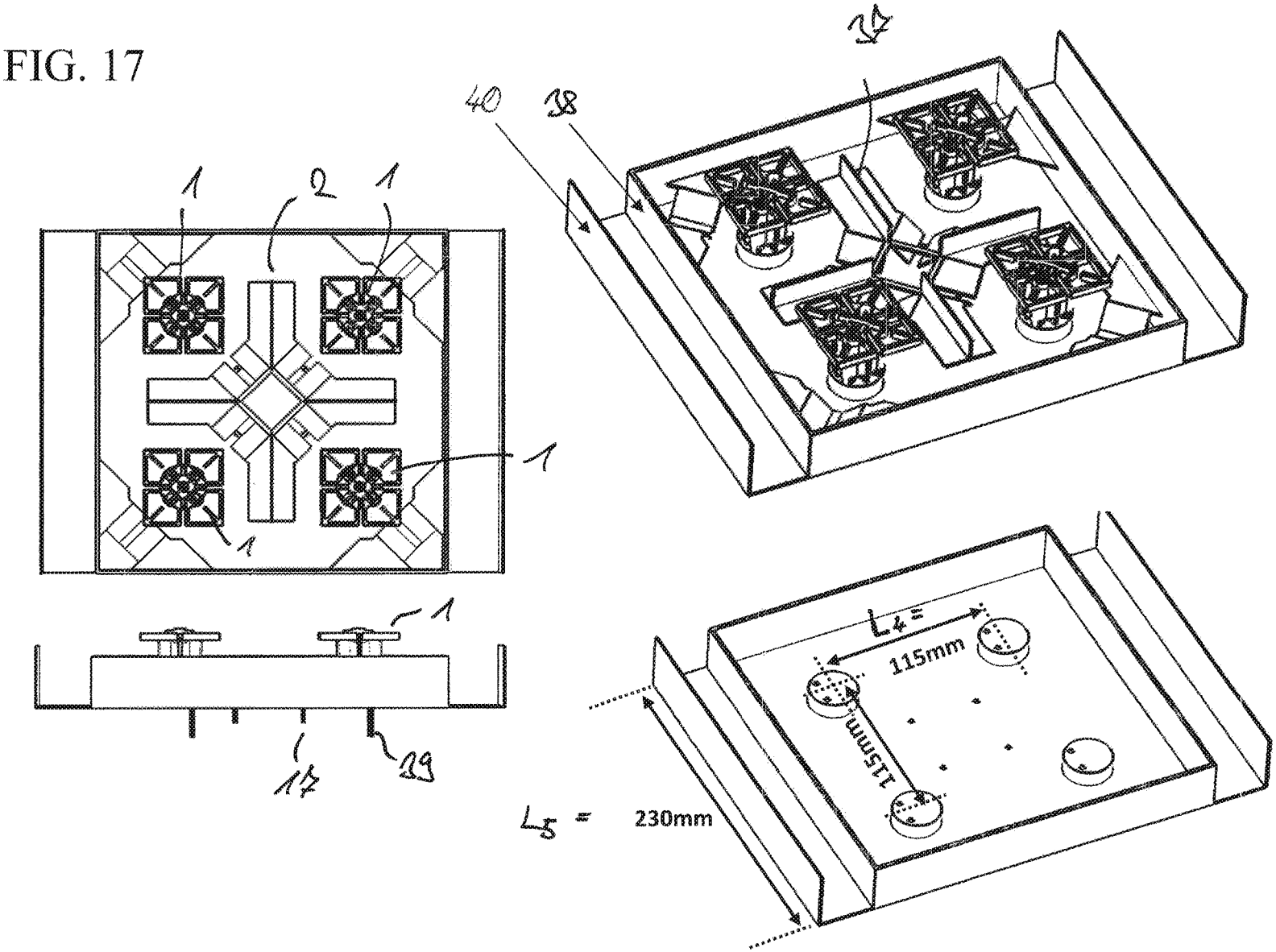
FIG. 17 shows another variant of an antenna according to the first aspect of the present disclosure as a basic element for creating a larger antenna array.

FIG. 17 shows another variant of an antenna according to the first aspect of the present disclosure, wherein the L-shaped structures forming the second radiator correspond to the embodiment in FIG. 16. In particular, frame elements 37 do not extend through the center of the second radiator, but only in the region of the legs of the L-shaped structures or of the arms of the cross-shaped structure.

The present disclosure is particularly interesting for the structure of multi-column antennas, wherein an antenna according to the first aspect serves as a basic element. The first radiators within the array antenna may have a distance of the individual radiators between 0.5λ and 0.7λ, which is particularly well suited for beam forming and/or MIMO applications.

FIG. 17 shows a possible basic element of such an array antenna. The basic element includes four first radiators 1, which serve as high-band radiators, as well as a second radiator 2, which serves as a low-band radiator.

The high-band radiators, in the embodiment, are operated in a frequency band between 1,710 MHz and 2,690 MHz, the low-band radiator in a frequency band between 880 MHz and 960 MHz. The respective radiators may have, for this purpose, resonance frequency ranges comprising these frequency bands. All radiators are dual-polarized X-pole radiators.

The solution according to the present disclosure has the advantage that the first radiators can be disposed very close side by side. In particular, the first radiators include a distance $L_4$ between 0.3 and 1.0λ, optionally between 0.4 and 0.8λ, further optionally between 0.5 and 0.7λ, wherein λ is the wavelength of the center frequency of the lowermost resonance frequency range of the first radiators.

In the embodiment, λ is for instance the wavelength at 920 MHz. The length $L_4$ of 115 mm corresponds to approx. 0.5λ.

Further, the same relationships may not only apply to the distance of the first radiators within the basic element, but also for the distance between adjacent first radiators of adjacent first basic elements. In the embodiment, the side length $L_5$ of the basic element therefore is twice the distance $L_4$ between two first radiators.

The basic element shown in FIG. 17 serves as a basic element for an array antenna with a planned repetition in the y-direction, i.e. for a one-column antenna with respect to the basic elements.

The embodiment shown in FIG. 17 of a basic element includes two frame elements 38 and 40, which extend in the y-direction. Inner frame element 38 serves as a reflector frame for the first radiators, and provides for a full width half maximum of 65 degrees for the first radiators. Outer frame element 40 serves, however, as a reflector for the second radiator, and provides here for a full width half maximum of 65 degrees.

Possible variations of an antenna according to the first aspect are described in the following in more detail.

The band width of the second radiator serving as a low-band radiator increases with the distance of the arms of the cross-shaped metal structure above the reflector plate. Thereby, however, the symmetry between the first polarization and the second polarization of the first radiators decreases, since thereby the distance between the cross-shaped metal structure and the corresponding dipole is reduced. If, therefore, for the first radiator for both polarizations, a similar directivity is intended, a compromise between the band width of the second radiator and the field symmetry of the first radiator needs to be found.

Figure 18:
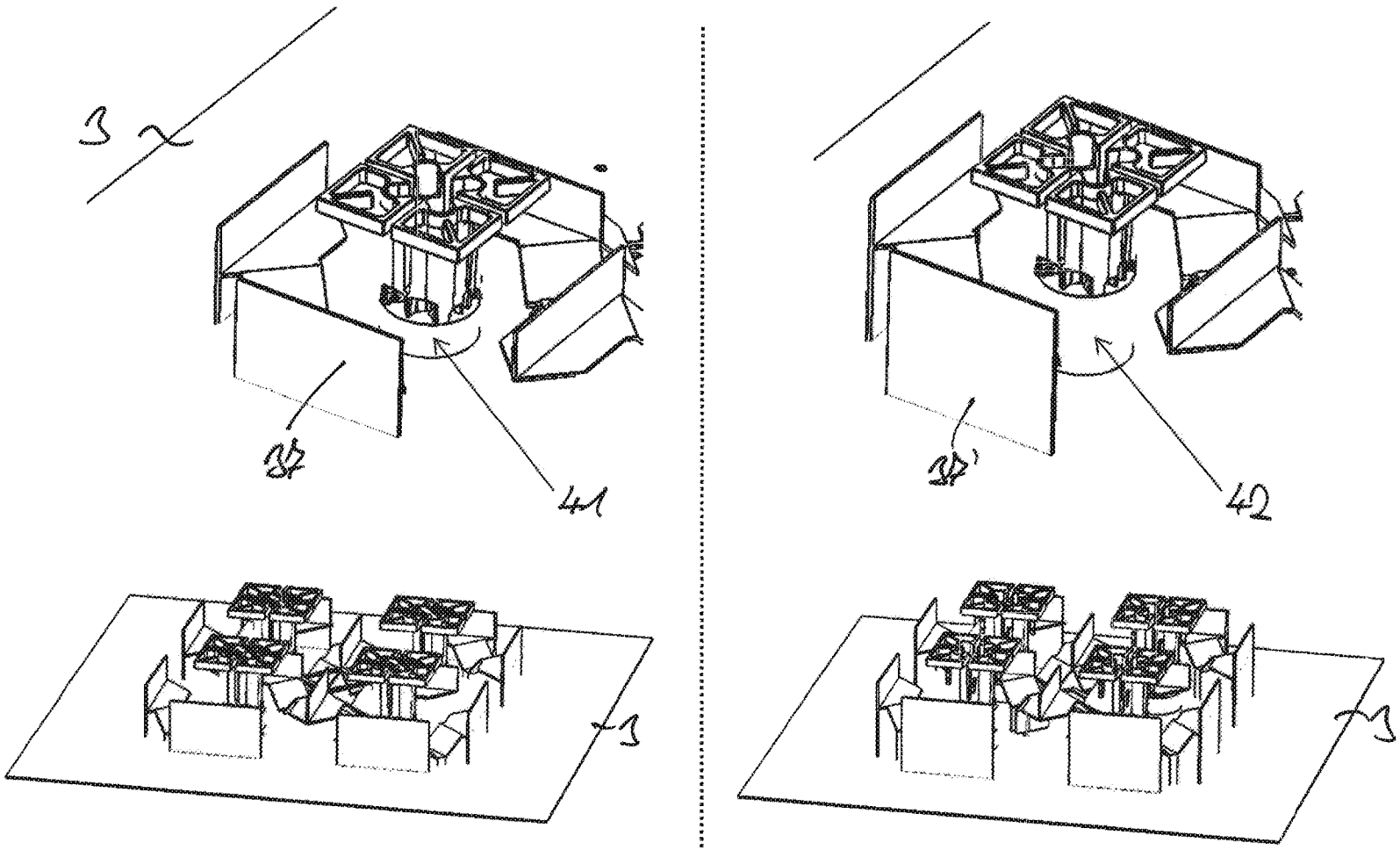
FIG. 18 shows two variants of a first radiator and its reflector environment according to the first aspect and an antenna constructed from four such radiators with their reflector environment, the two variants differing in view of the height of the socket of the first antenna or the distance of the dipole elements of the first antenna to the reflector plane.

As shown in FIG. 18, for this purpose, the height of the socket of the first radiators can be modified. On the left in FIG. 18 is shown a lower socket 41, and correspondingly, a first reflector environment 37 with a relatively low distance to the reflector plane and thus a smaller band width. On the right in FIG. 18, however, a first radiator with a higher socket 42 is shown, so that also the height of the reflector environment 37' and its distance to the reflector plate can be increased, in order to increase the band width of the second radiator.

The full width half maximum and the gain of the first radiators in particular depend of the shape of the reflector environment of the first radiators and thus the shape of the second radiator formed thereby.

Figure 19:
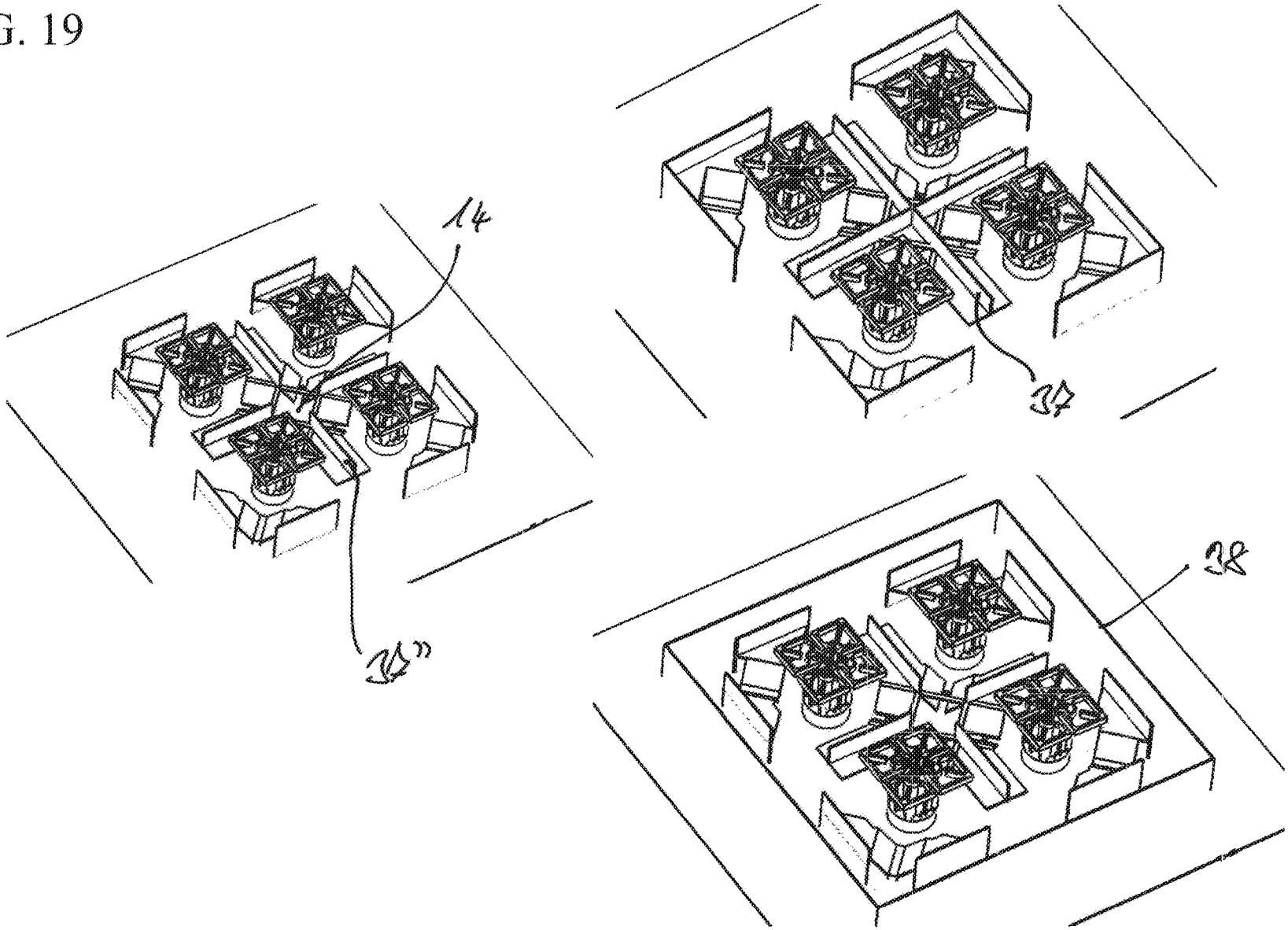
FIG. 19 shows three variants of an antenna according to the first and the second aspects of the present disclosure, which differ by the specific embodiment of the reflector environment.

FIG. 19 shows a plurality of variants with different shapes of the L-shaped structures of the reflector environment of the first radiators and thus the shape of the second radiator. On the left in FIG. 19 are provided vertically extending frame elements 37", which extend along the legs of the L-shaped structures or the arms of the cross-shaped structure of the second radiator, however, omitting the region of the diagonal. In the embodiment at top right in FIG. 19, the frame elements are connected to each other over inner recess 14 of the second radiator. In the embodiment at bottom right in FIG. 19, an additional frame 38 is provided, which serves as a reflector frame for the second radiator.

The present disclosure according to the first aspect is suited particularly well for array antennas with a plurality of columns and rows at first radiators. In particular, when at least four columns or rows of first radiators are employed, the complete reflector environment of the first radiators disposed inside can be utilized as a second radiator. It is further possible to employ different second radiators within the array antenna, and in particular second radiators with different resonance frequency ranges.

Figure 20:
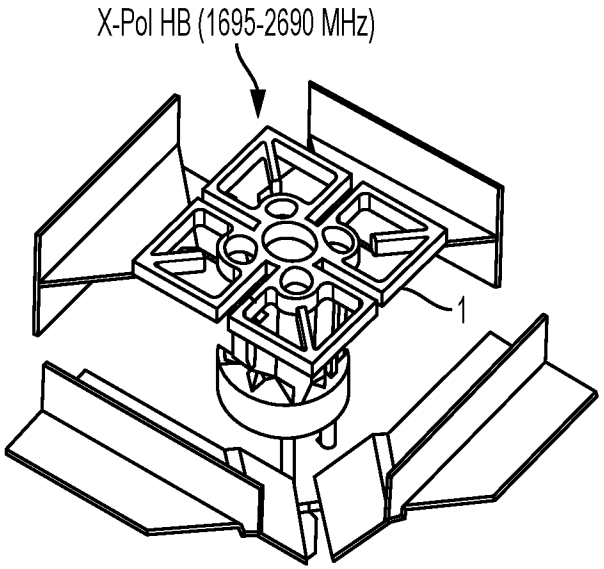
FIG. 20 shows the reflector environment of a first radiator of an antenna according to the first aspect of the present disclosure, the reflector environment being constructed from two different metal structures forming a part of a second radiator with a different resonance frequency range.
Figure 20:
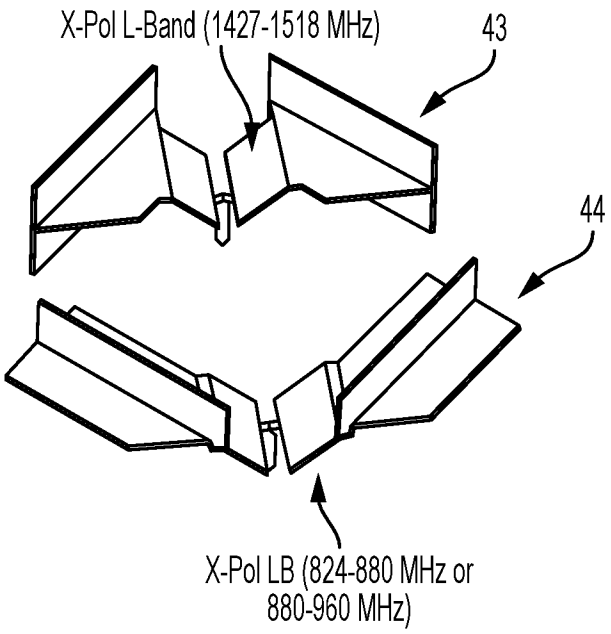

FIG. 20 shows on the right a first radiator 1 with its reflector environment, and on the left this reflector environment once again separately. The reflector environment again consists of two L-shaped structures 43 and 44. The two L-shaped structures have a different leg length, and serve as components of second radiators with different resonance frequency ranges.

In the embodiment, first radiator 1 serves as a high-band radiator for a frequency band between 1,695 and 2,690 MHz, first L-shaped metal structure 43 serves as a part of a second radiator, which serves as a low-band radiator for a frequency band between 1,427 and 1,518 MHz, and second L-shaped metal structure 44 serves as a component of a second radiator, which serves as a low-band radiator for a frequency band between 824 and 880 MHz or between 880 and 960 MHz. The respective lowermost resonance frequency ranges of the first and second radiators may comprise the respectively specified frequency bands.

Figure 21:
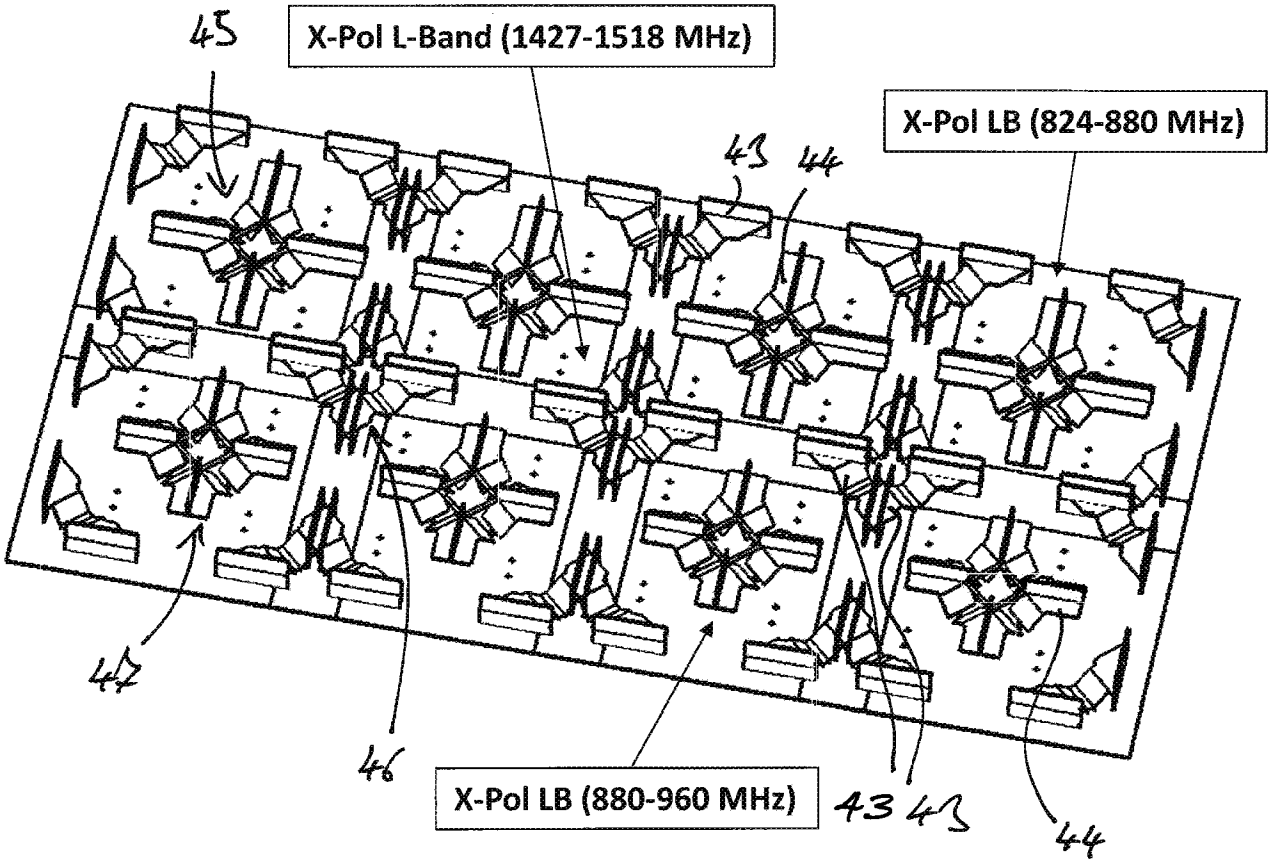
FIG. 21 shows an embodiment of an antenna array of a plurality of antennas according to the first aspect of the present disclosure with three different second radiators constructed from the reflector environment of the first radiators surrounding them for three different frequency ranges.

FIG. 21 shows an embodiment for an array antenna, wherein the reflector environments of the first radiator shown in FIG. 20 are employed. In FIG. 21, the first radiators are not shown for better clarity, in FIGS. 22 and 23 is, however, the complete array antenna including the first radiators is shown.

First radiators 1, in the embodiment, are disposed in four columns 49. The parts of the reflector environment of the first radiators disposed in the interior of the array antenna form second radiators. The L-shaped structures of four first radiators disposed in a rectangle form a second radiator. Therefore, the array antenna includes three columns of second radiators, which are respectively disposed between the columns at first radiators.

Figure 22:
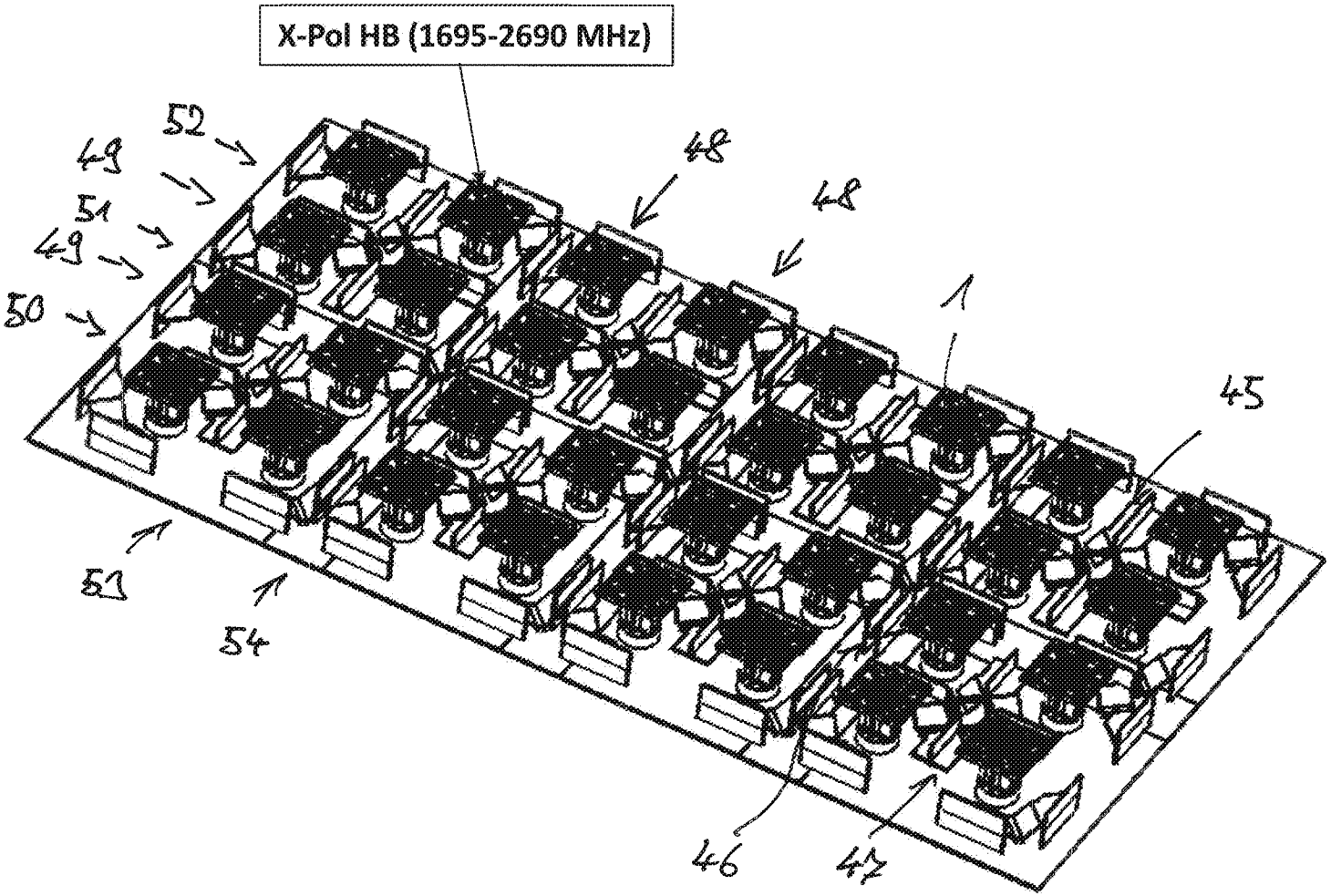
FIG. 22 shows the embodiment shown in FIG. 21, wherein here the first radiators are also shown.
Figure 23:
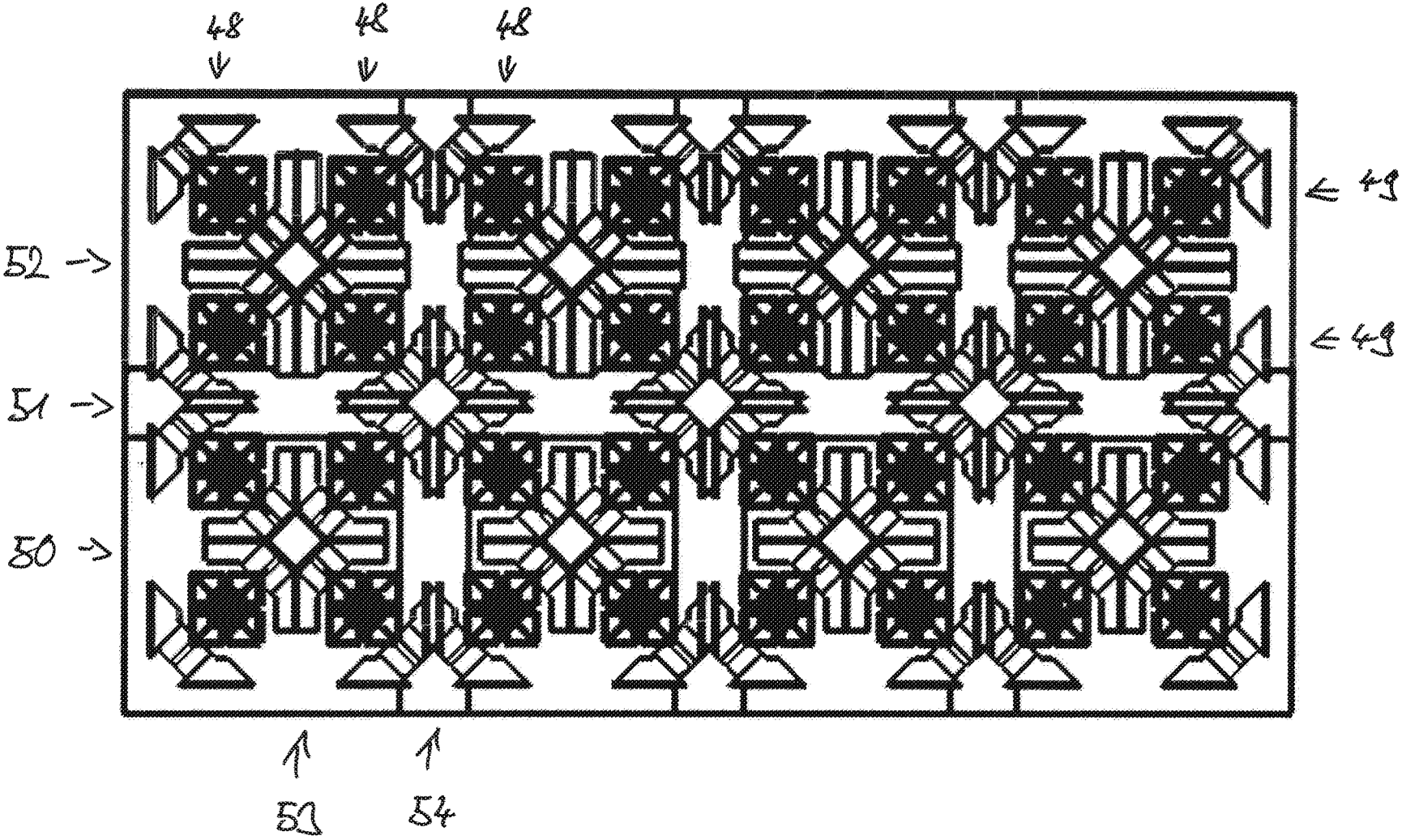
FIG. 23 shows the embodiment shown in FIG. 22 in a plan view.

This is made clear in FIGS. 22 and 23. Four columns 49 of first radiators 1 are provided, which are respectively disposed in rows 48 of four radiators. Between columns 49 of first radiators, columns 50, 51 and 52 with second radiators are provided. The two outer columns 50 and 52 each include second radiators, which are disposed side by side in a row 53. The second radiators of the middle column 51 are, however, offset relative to the second radiators of the outer columns 50 and 52. There is here, therefore, one row 54 each with only one second radiator.

Second radiators 45 of column 52 are formed by four L-shaped structures 44, second radiator 46 of middle column 51 by four L-shaped structures 43, and second radiator 47 of column 50 by four L-shaped structures 44, however, with a different leg length.

Overall, the array antenna thus includes, in the embodiment, three different second types of radiators, which are employed for three different frequency ranges, and that, in the embodiment, radiator 45 for the frequency range between 824 and 880 MHz, radiator 46 for the frequency range between 1,427 and 1,518 MHz, and radiator 47 for the frequency range between 880 and 960 MHz.

Of course, the array antenna shown in FIGS. 21 to 23 could also be extended by further columns and/or rows. Further, the array antenna could also be provided with nothing but identical second radiators or with only two different types of second radiators.

In the embodiment, an array arrangement with 100 mm distance between the first radiators and 200 mm between the second radiators was selected.

The invention claimed is:

1. An antenna for mobile communication comprising a plurality of first radiators and at least one second radiator, which are disposed on a common reflector plane, the first radiators each including a reflector environment raised relative to the reflector plane, wherein the second radiator is disposed between the plurality of first radiators and is formed by parts of respective reflector environment of the first radiators, wherein, in a side view, the first radiators are disposed higher above the reflector plane than the reflector environment forming the second radiator, and wherein the at least one second radiator comprises at least two arms connected by a bridge, wherein at least a portion of the bridge is in a plane not parallel with (a) the common reflector plane and (b) planes of the at least two arms.

2. The antenna for mobile communication of claim 1, wherein the first radiators are high-band radiators and the second radiator is a low-band radiator, and/or wherein the reflector environment forming the second radiator extends at least partially in a plane extending substantially in parallel to the reflector plane.

3. The antenna for mobile communication of claim 1, wherein the second radiator is disposed between four first radiators disposed in a rectangle, wherein the parts of the reflector environment of the first radiators forming the second radiator extend out of the rectangle formed by centers of the four first radiators, and/or wherein the second radiator formed by parts of the respective reflector environment of the first radiators surrounding it comprises a cross-shaped metal structure, which is disposed between four first radiators disposed in a rectangle, wherein a center of the cross-shaped metal structure is disposed in a center of the rectangle, and/or wherein arms of the cross-shaped metal structure respectively extend between two first radiators.

4. The antenna for mobile communication of claim 3, wherein the second radiator includes one or two symmetry axes extending in parallel to sides of the rectangle; and/or wherein between the respective reflector environment provided.

5. The antenna for mobile communication of claim 1, wherein the reflector environment of every first radiator comprises a first metal structure and a second metal structure facing each other with respect to the first radiator and being separated from each other by an interspace, wherein the first and second metal structures form a reflector frame for the first radiators, wherein the first metal structure or the second metal structure provided between four first radiators disposed in a rectangle commonly form a metal structure of a second radiator, and/or wherein the first and second metal structures each include an L-shape, and are disposed in the form of a rectangle around the first radiator, and/or legs of four L-shaped first or second metal structures together form a cross-shaped metal structure of a second radiator.

6. The antenna for mobile communication of claim 5, wherein a first polarization plane of the first radiators extends along the interspace between the first and second metal structures, wherein the first radiator includes a second orthogonal polarization plane, which extends centrally through the first and second metal structures and forms a symmetry axis of the first and second metal structures, and wherein the first and second metal structures each include an L-shape and are disposed in the form of a rectangle around the first radiator, wherein the first polarization plane extends diagonally between the two L-shaped metal structures, and the second orthogonal polarization plane extends through apexes of the two L-shaped metal structures.

7. The antenna for mobile communication of claim 5, wherein the reflector environment of the first radiators includes a depression in a region of a polarization plane of the respective first radiator and/or in a region of a diagonal of a rectangle formed by the centers of the first radiators, the depression extending along the polarization plane and/or the diagonal, and/or wherein the parts of the reflector environment of the first radiators forming the second radiator are fed in the region of the diagonal of a rectangle formed by the centers of the first radiators and/or in the region of the diagonal of the cross-shaped metal structure forming the second radiator and/or include, in the region of its diagonal, slots extending along the diagonal and/or being bridged by webs, and/or wherein the cross-shaped metal structure of the second radiator is fed in the region of its diagonal and/or includes, in the region of its diagonal, slots extending along the diagonal and/or being bridged by webs.

8. The antenna for mobile communication of claim 7, wherein the cross-shaped metal structure includes a depression in the region of its diagonal and/or wherein the first and a second L-shaped metal structures include a depression in the region of their diagonal, the depression being disposed in the polarization plane of a first radiator and extending along the polarization plane, and/or wherein the cross-shaped metal structure includes an opening in its center, in a region of the opening an adjustment structure being provided, if applicable.

9. The antenna for mobile communication of claim 5, wherein the cross-shaped metal structure and/or the first and second L-shaped metal structures consist of one or a plurality of sheet-metal parts, wherein the cross-shaped metal structure includes a single-piece or multi-piece basic element stamped and folded from sheet metal, which unites four L-shaped metal structures, and/or wherein the cross-shaped metal structure and/or the first and second L-shaped metal structures include frame elements extending perpendicularly to the reflector plane and forming a vertical reflector frame for the first radiators.

10. The mobile antenna for mobile communication of claim 9, wherein the cross-shaped metal structure and/or the first and second L-shaped metal structures comprise regions extending in parallel to the reflector plane, wherein these regions extend in parallel to sides of the rectangle formed by the centers of the first radiators and/or in a region of the legs of the cross-shaped metal structure and/or of the first and second L-shaped metal structures.

11. The antenna for mobile communication of claim 1, wherein the first radiators are dipole radiators, wherein the dipole elements of the dipole radiators are disposed via a socket on a common reflector and include a larger distance to the reflector than the parts of the reflector environment forming the first radiator, and/or wherein the second radiator is fed as a patch antenna and/or is a dual-polarized radiator, wherein polarization planes of the second radiator extend along a diagonal of the cross-shaped metal structure.

12. The antenna for mobile communication of claim 1, wherein the first radiators include a distance of the individual radiators of 0.5λ to 0.7λ, wherein λ is a wavelength of a center frequency of a lowermost resonance frequency range of the first radiators, and/or wherein the first radiators include a distance to the reflector plane between 0.15λ and 0.6λ, wherein λ is the wavelength of the center frequency of the lowermost resonance frequency range of the first radiators.

13. The antenna for mobile communication of claim 1, wherein the plurality of first radiators each include a same reflector environment and/or the same resonance frequency ranges and/or a same orientation of the polarization planes and/or a same structure, and/or with a plurality of second radiators, which each have a same resonance frequency ranges and/or a same orientation of the polarization planes and/or a same structure, and/or with at least two second radiators, which have different resonance frequency ranges and/or a different structure, wherein a first radiator is disposed between the two second radiators and includes a reflector environment, which consists of at least two different parts comprising two L-shaped metal structures with a different leg length.

14. The antenna for mobile communication of claim 13, wherein a first antenna array formed by a plurality of first radiators with a plurality of columns and rows and a second antenna array formed by a plurality of second radiators with at least one environment of the first radiators surrounding them, wherein the second antenna array is disposed in at least two rows and/or columns, the radiators of which are offset relative to each other, and/or the radiators of which have different resonance frequency ranges and/or a different structure.

15. The antenna for mobile communication of claim 1, wherein the reflector environment of the first radiators forms a reflector frame for the first radiators.

16. An antenna for mobile communication comprising a reflector plane and an element fed as a patch antenna disposed above the reflector plane, wherein the element fed as a patch antenna is formed by a cross-shaped metal structure comprising an inner opening and a plurality of arms connected by a number of V-shaped bridges surrounding the inner opening, wherein the cross-shaped metal structure forms a dual-polarized radiator, and wherein polarization planes of the dual-polarized radiator extend along diagonals of the cross-shaped metal structure, wherein at least a portion of the bridges is in a plane not parallel with (a) a common reflector plane and (b) planes of the plurality of arms.

17. The antenna for mobile communication of claim 16, wherein the cross-shaped metal structure includes a distance to the reflector plane changing along its extension, parallel to the reflector plane, these regions extending in a region of arms of the cross-shaped metal structure, and/or wherein the cross-shaped metal structure includes regions extending perpendicularly to the reflector plane, which extend along a median plane of four arms of the cross-shaped metal structure.

18. The antenna for mobile communication of claim 17, wherein the cross-shaped metal structure is fed in the region of its diagonal, wherein feed occurs asymmetrically at a respective feed point on the diagonal or symmetrically at two feed points on the diagonal, which are facing each other with respect to a center of the cross-shaped metal structure, wherein the symmetrical feed occurs in a serial or parallel manner, and/or wherein the cross-shaped metal structure includes slots in the region of its diagonal, said slots extending along the diagonal and/or being bridged by webs, and/or wherein the cross-shaped metal structure includes an opening in its center, in a region of the opening an adjustment structure being provided, if applicable, and folded from sheet metal, which comprises the four arms of the cross-shaped metal structure and includes a recess in its center.

19. The antenna for mobile communication of claim 17, wherein the cross-shaped metal structure consists of one or a plurality of sheet-metal parts, wherein the cross-shaped metal structure includes a single-piece or multi-piece basic element stamped and folded from sheet metal, which comprises the four arms of the cross-shaped metal structure and includes a recess in its center.

20. The antenna for mobile communication of claim 16, where the cross-shaped metal structure is electrically coupled to a first conductor and a reflector plate is electrically coupled to a second conductor of a signal line.

21. A mobile communication base station comprising an antenna for mobile communication, the antenna comprising a plurality of first radiators and at least one second radiator, which are disposed on a common reflector plane, the first radiators each including a reflector environment raised relative to the reflector plane, wherein the second radiator is disposed between a plurality of first radiators and is formed by parts of the respective reflector environment of the first radiators surrounding it, wherein, in a side view, the first radiators are disposed higher above the reflector plane than the reflector environment forming the second radiator, wherein the at least one second radiator comprises at least two arms connected by a bridge, and wherein at least a portion of the bridge is in a plane not parallel with (a) the common reflector plane and (b) planes of the at least two arms.

* * * * *